US008777785B2

(12) United States Patent
Martino

(10) Patent No.: US 8,777,785 B2
(45) Date of Patent: Jul. 15, 2014

(54) SELF-PROPELLED FOOTBALL WITH GYROSCOPIC PRECESSION COUNTERMEASURES

(76) Inventor: Marc Gregory Martino, Westlake Village, CA (US)

( * ) Notice: Subject to any disclaimer, the term of this patent is extended or adjusted under 35 U.S.C. 154(b) by 468 days.

(21) Appl. No.: 13/046,089

(22) Filed: Mar. 11, 2011

(65) Prior Publication Data

US 2011/0237151 A1 Sep. 29, 2011

Related U.S. Application Data

(60) Provisional application No. 61/341,124, filed on Mar. 26, 2010.

(51) Int. Cl.
*A63B 71/02* (2006.01)

(52) U.S. Cl.
USPC ..... 473/570; 473/612

(58) Field of Classification Search
USPC ..... 473/570, 613, 612; 273/108.4, 317.5
See application file for complete search history.

(56) References Cited

U.S. PATENT DOCUMENTS

| | | | | |
|---|---|---|---|---|
| 2,051,151 | A | | 8/1936 | Northrop |
| 3,224,488 | A | | 12/1965 | Goldfarb |
| 3,256,020 | A | | 6/1966 | Smith |
| 3,884,466 | A | | 5/1975 | MacDonald et al. |
| 4,065,873 | A | * | 1/1978 | Jones ..... 446/37 |
| 4,335,537 | A | | 6/1982 | Walker |
| 4,736,948 | A | | 4/1988 | Thomas |
| 4,923,196 | A | | 5/1990 | Rohring |
| 5,063,735 | A | | 11/1991 | Colgren et al. |
| 5,133,550 | A | | 7/1992 | Handy |
| 5,228,690 | A | | 7/1993 | Rudell et al. |
| RE34,383 | E | | 9/1993 | Rohring |
| 5,267,735 | A | | 12/1993 | Bushman |
| 5,269,514 | A | | 12/1993 | Adler et al. |
| 5,284,341 | A | | 2/1994 | Routzong et al. |
| D346,001 | S | | 4/1994 | Stillinger et al. |
| 5,362,065 | A | | 11/1994 | Su |
| D361,811 | S | | 8/1995 | Grimm et al. |
| 5,458,329 | A | | 10/1995 | Bushman et al. |
| 5,779,576 | A | | 7/1998 | Smith, III et al. |
| 5,807,198 | A | | 9/1998 | Grimm |
| D419,205 | S | | 1/2000 | Kownacki et al. |
| 6,010,419 | A | | 1/2000 | Rappaport et al. |
| 6,024,660 | A | | 2/2000 | Romanick |
| 6,042,494 | A | | 3/2000 | Rappaport et al. |
| 6,048,247 | A | | 4/2000 | Kownacki et al. |
| 6,056,616 | A | | 5/2000 | Bushman |
| 6,079,954 | A | | 6/2000 | Kownacki et al. |
| 6,120,398 | A | | 9/2000 | Myers |
| 6,157,898 | A | | 12/2000 | Marinelli |

(Continued)

*Primary Examiner* — Arthur O Hall
*Assistant Examiner* — Allen Chan

(57) ABSTRACT

A self-propelled flying toy includes a body defined as having a front section, a center section and a back section each along a longitudinal axis. A ducted fan is located within the body substantially centered about the longitudinal axis. A motor is mechanically coupled to the ducted fan and a power source is coupled to the motor. An air-inlet is located substantially within the front section in airflow communication with the ducted fan. An air-outlet is located substantially within the back section in airflow communication with the ducted fan. At least two angled surfaces are fixed relative to the body and located substantially within the front section. Each of the at least two angled surfaces are evenly centered about the longitudinal axis and facing an opposite thrust-generating rotational direction relative to the ducted fan.

24 Claims, 17 Drawing Sheets

(56) References Cited

U.S. PATENT DOCUMENTS

| | | | | |
|---|---|---|---|---|
| 6,347,623 | B1 | 2/2002 | Kownacki et al. | |
| 6,454,623 | B1 | 9/2002 | Flatau | |
| 6,550,715 | B1 | 4/2003 | Reynolds et al. | |
| 6,568,980 | B2 | 5/2003 | Barthold | |
| 6,612,893 | B2 | 9/2003 | Rehkemper et al. | |
| 6,669,587 | B2 | 12/2003 | Kessler | |
| 6,695,728 | B1 | 2/2004 | Eddins | |
| 6,843,699 | B2 | 1/2005 | Davis | |
| 6,899,586 | B2 | 5/2005 | Davis | |
| 6,921,315 | B2 | 7/2005 | Kownacki | |
| 7,032,861 | B2 | 4/2006 | Sanders, Jr. et al. | |
| 7,073,750 | B1 | 7/2006 | Choi | |
| 7,255,623 | B2 | 8/2007 | Davis | |
| 7,288,037 | B2 | 10/2007 | Myers | |
| D576,216 | S | 9/2008 | Van de Rostyne et al. | |
| D577,392 | S | 9/2008 | Van de Rostyne et al. | |
| 7,500,898 | B2 | 3/2009 | Laurienzo et al. | |
| 7,798,883 | B2 | 9/2010 | Elson et al. | |
| 7,811,150 | B2 | 10/2010 | Amireh et al. | |
| 2001/0039221 | A1 | 11/2001 | Schneider | |
| 2003/0027672 | A1 | 2/2003 | Leal et al. | |
| 2004/0169485 | A1 | 9/2004 | Clancy | |
| 2006/0144994 | A1 | 7/2006 | Spirov | |
| 2008/0039246 | A1* | 2/2008 | Martino | 473/569 |
| 2008/0039250 | A1* | 2/2008 | Martino | 473/613 |

* cited by examiner

SELF-PROPELLED FOOTBALL WITH GYROSCOPIC PRECESSION COUNTERMEASURES

CROSS-REFERENCE TO RELATED APPLICATION

This non-provisional patent application claims priority to the previously filed provisional patent application No. 61/341,124 filed on Mar. 26, 2010 by inventor Marc Gregory Martino.

DESCRIPTION

1. Field of the Invention

The present invention generally relates to self-propelled flying toys. More particularly, the present invention's claims relates to a substantially football-shaped flying toy with features designed to counteract the affects of gyroscopic precession and other improvements.

2. Background of the Inventions

This disclosure teaches a variety of flying toys. First, there are several improvements for a self-propelled flying toy, herein referred to commonly as the Jetball. The Jetball can resemble a football and be used in a similar manner for throwing and catching. The improvements to the self-propelled flying toy are a continuation of the developments previously disclosed in application Ser. No. 11/500,749 filed on Aug. 8, 2006 and also the CIP application Ser. No. 11/789,223 filed on Apr. 24, 2007, which are both incorporated in full herein by reference.

The self-propelled flying toy includes a body with a ducted fan located inside the body and along a longitudinal axis. A motor and power source drive the ducted fan to create thrust for self-propulsion. Air is drawn in through air-inlets along the front of the body and can also be drawn through auxiliary air-inlets around the center of the body. Thrust is directed through an air-outlet at the back of the body. To counter the affects of gyroscopic precession, the front of the body has at least two angled surfaces facing an opposite thrust-generating rotational direction relative to the ducted fan. These angled faces create an opposite gyroscopic precession force which then cancels out the gyroscopic precession from the ducted fan. The result is a flying toy that flies in a straight direction.

Second, a new toy is disclosed as a self-propelled rocket. This toy is commonly referred to as the PropRocket. The PropRocket is a safe alternative to the combustion driven model rockets commonly used today. Combustion driven rockets are extremely dangerous and not suitable for unsupervised play by children. The PropRocket is electrically powered and easily rechargeable and quickly relaunchable. The self-propelled rocket toy includes an elongated body with a propeller coupled at the bottom end. An electric motor and power source drive the propeller to create an upward thrust. There are a variety of activation methods that are possible with the electric rocket, including technology developed in the Jetball.

Third, a new toy is disclosed as a throwing and catching flying toy. This toy is commonly referred to either as the Flying Football, the Wing-It Football or the Gliding Football. The throwing and catching flying toy includes a structural support attached with a lift-generating wing. A body which is used to throw and catch the toy is rotatably attached to the support. A tail and tail fin are connected either to the body or the structure and provides stability in the air, much as a tail fin on an airplane does. The body spins in the air when thrown similar to a football, yet the structural support and wings remain level during flight for producing lift. The result is the farthest flying football, allowing users to greatly increase the distance thrown.

Fourth, a new toy is disclosed as a bowless arrow which is commonly referred to as the Bowless Arrow. The toy is similar to an arrow, in that it flies through the air like an arrow, yet can be launched without an auxiliary bow. This is because the bow functionality has been integrated into the arrow. The bowless arrow includes a shaft with a slider translatably coupled. A resiliently stretchable bias, such as a rubber band or spring, is attached to the slider and the rear of the arrow. The slider is held in the front-hand while the arrow is drawn backwards with the rear-hand. Upon release, the slider forces the body of the arrow forward against the forward-hand.

In another variation upon the Bowless Arrow, lift-producing wings can be attached to the body such that the toy is able to glide substantially further. This is a fifth new product and is commonly referred to as the Arrow Plane.

Sixth, a new toy is disclosed as a distance-enhanced throwing toy. This toy is commonly referred to as the Catapult Javelin, for lack of a better name. The distance-enhanced throwing toy includes an elongated shaft with a tail fin at the rear for stability. An elongated handle is pivotably attached near the front of the shaft. The handle is temporarily and securedly biased and pivotable between a first position and a second position. The handle and shaft are generally parallel in the first position and the handle and shaft are generally perpendicular in the second position. A person can grab the handle in the second position and swing the toy at an increased velocity as compared to a normal throwing motion, such as with a football or baseball. The release speed is increased because of the length of the handle is further away from the body of the person throwing it. Upon release, the handle moves into the first position such that the overall toy is aerodynamic for forward flight.

Seventh, a new toy is disclosed as a throwing and flying toy. This toy is commonly referred to as the Cruise Missile, as its shape can be formed to resemble a cruise missile. The Cruise Missile is similar in nature to the Catapult Javelin, but also includes lift-producing wings for substantially increased distance thrown. The throwing and flying toy includes an elongated body having a front portion rotatably attached to a rear portion. A tail fin and lift-generating wing are attached to the rear portion, while an elongated handle is pivotably attached to the front portion of the body. The handle is temporarily and securedly biased and pivotable between a first position and a second position similar to the Catapult Javelin. Not only is the speed at which the toy thrown increased, but lift generated by the wings also increases the distance thrown.

New toy designs are constantly being invented to satisfy the curiosity and interest of the consuming public. Flying toys are of particular interest and has become a billion dollar industry. Accordingly, there is always a need for a variety of new flying toys. The present inventions fulfill these needs and provide other related advantages.

SUMMARY OF THE INVENTIONS

Jetball—Gyroscopic Precession Countermeasures:

A self-propelled flying toy is disclosed comprising a body defined as including a front section, a center section and a back section each along a longitudinal axis. A ducted fan is located within the body substantially centered about the longitudinal axis. A motor is mechanically coupled to the ducted fan and a power source is coupled to the motor, either electrically or energetically. An air-inlet is located substantially within the front section in airflow communication with the ducted fan. An air-outlet is located substantially within the back section in airflow communication with the ducted fan. At least two angled surfaces are fixed relative to the body and located substantially within the front section. Each of the at least two angled surfaces are substantially evenly centered about the longitudinal axis and facing an opposite thrust-generating rotational direction relative to the ducted fan.

In an exemplary embodiment of the present invention, the at least two angled surfaces may be in airflow communication with the air-inlet. The at least two angled surfaces may comprise a plurality of angled surfaces.

In another exemplary embodiment the body may be shaped as an oblate spheroid. Furthermore, the oblate spheroidal body may truncated perpendicular to the longitudinal axis located substantially about the back section. The air outlet may be substantially 3.5 inches in diameter or greater.

Another exemplary embodiment may include an auxiliary air-inlet located substantially within the center section about the longitudinal axis in airflow communication with the ducted fan. The auxiliary air-inlet may comprise a plurality of auxiliary air-inlets. The plurality of auxiliary air-inlets may each define an aperture extending substantially about 0.5 inches or greater ahead and about 0.5 inches or greater behind the ducted fan in a direction along the longitudinal axis. Furthermore, the air-inlet, auxiliary air-inlet and air-outlet each may include an air-permeable structure.

Another exemplary embodiment may include a centrifugal switch disposed within the body detecting rotation about the longitudinal axis. The centrifugal switch may regulate operation of the ducted fan, wherein the ducted fan is powered when rotation about the longitudinal axis is detected and not powered when rotation about the longitudinal axis is not detected. Said differently, another embodiment may include a means for automatic activation and deactivation of the motor by detecting an in-flight condition and a not-in-flight condition, wherein such means is located within the body and in communication with the motor and power source. Also, the embodiment may include a timer located within the body in communication with the motor and power source, wherein the motor after activation will automatically turn off after a predetermined time.

Jetball—Auxiliary Air-Inlet:

A self-propelled flying toy is disclosed comprising a body defined as including a front section, a center section and a back section each along a longitudinal axis. A ducted fan is located within the body substantially centered about the longitudinal axis. A motor is mechanically coupled to the ducted fan and a power source is coupled to the motor. An air-inlet is located substantially within the front section in airflow communication with the ducted fan. An air-outlet is located substantially within the back section in airflow communication with the ducted fan. An auxiliary air-inlet is located substantially within the center section about the longitudinal axis in airflow communication with the ducted fan.

In various exemplary embodiments the auxiliary air-inlet may comprise a plurality of auxiliary air-inlets all located substantially within the center section about the longitudinal axis each in airflow communication with the ducted fan. Also, the plurality of auxiliary air-inlets may each extend substantially at least 0.5 inches ahead and 0.5 inches behind the ducted fan in a direction along the longitudinal axis. The plurality of auxiliary air-inlets may each comprise an air-permeable structure.

Another exemplary embodiment may include a centrifugal switch located within the body detecting rotation about the longitudinal axis. The centrifugal switch regulates operation of the ducted fan, wherein the ducted fan is powered when rotation about the longitudinal axis is detected and not powered when rotation about the longitudinal axis is not detected. Said differently, another embodiment may include a means for automatic activation and deactivation of the motor by detecting an in-flight condition and a not-in-flight condition, wherein such means is located within the body and in communication with the motor and power source. Furthermore, a timer may be located within the body in communication with the motor and power source, wherein the motor after activation will automatically turn off after a predetermined time.

Another exemplary embodiment may include at least two angled surfaces fixed relative to the body disposed substantially within the front section, wherein each of the at least two angled surfaces are substantially evenly centered about the longitudinal axis and facing an opposite thrust-generating rotational direction relative to the ducted fan. The at least two angled surfaces may also be in airflow communication with the air-inlet. The at least two angled surfaces may also comprise a plurality of angled surfaces evenly centered about the longitudinal axis.

In another exemplary embodiment, the body may be an oblate spheroidal shape. Furthermore, the oblate spheroidal body may be truncated perpendicular to the longitudinal axis disposed about the back section. Additionally, the air outlet may be substantially 3.5 inches in diameter or greater.

PropRockets:

A self-propelled rocket toy is disclosed comprising a substantially elongated body located along a longitudinal axis which is defined as including a top end opposite a bottom end. A propeller is substantially centered about the longitudinal axis located about the bottom end. An electric motor is mechanically coupled to the propeller. A power source is electrically coupled to the electric motor. An activation mechanism is electrically coupled to the electric motor and power source.

In various exemplary embodiments the power source may comprise a rechargeable battery, such as a NiCad, NiMh, or LiPo battery. Alternatively, the power source may comprise a capacitor.

Another exemplary embodiment may include at least three supports outwardly extending from and fixed relative to the body, each support substantially evenly spaced about the longitudinal axis and extending below the propeller. Furthermore, a ring may be aligned around the longitudinal axis and propeller. The ring may also be connected to the at least three supports. Also, the at least three supports may be lift-generating devices each angled at an opposite thrust-generating rotational direction relative to the propeller.

In another exemplary embodiment, the activation mechanism may comprise a launch button located relative to the body and in communication with the electric motor and power source. A timer may be located within the body in communication with the electric motor and power source, wherein the electric motor after activation will automatically turn off after a predetermined time. Alternatively, the activation mechanism may comprise a receiver disposed within the body in electrical communication with the electric motor and including a remote launch transmitter for remotely activating the electric motor and propeller.

In another exemplary embodiment, the activation mechanism may comprise a centrifugal switch disposed within the body and in communication with the electric motor and power source, wherein the centrifugal switch is configured upon detecting rotation about the longitudinal axis to activate the electric motor and propeller. Again, a timer may be located within the body in communication with the electric motor and power source, wherein the electric motor after activation will automatically turn off after a predetermined time. Said differently, the activation mechanism may comprise a means for automatic activation and deactivation of the motor by detecting an in-flight condition and a not-in-flight condition, wherein such means is located within the body and in communication with the electric motor and power source. A timer may be located within the body in communication with the motor and power source, wherein the motor after activation will automatically turn off after a predetermined time.

Flying Football:

A throwing and catching flying toy is disclosed comprising a structural support including a lift-generating wing attached relative to the support. A body is rotatably attached relative to the support, wherein the body comprises a front section fixed relative to a rear section. Both the front and rear sections rotate about a longitudinal axis. A tail is located relative to either the support or the body extending in a direction beyond the rear section of the body. A tail fin is attached relative to an end of the tail.

In an exemplary embodiment, the wing may be pivotably adjustable in a pitch axis relative to the support. A thumb grip may be fixed relative to the support and located along and adjacent to the rear section of the body. The wing may comprise a breakaway wing or also be a dihedral wing. The dihedral angle may be at or greater than 10 degrees or 20 degrees. The wing may also be positioned above the longitudinal axis.

In another exemplary embodiment, the body may comprise a generally oblate spheroidal or football shape. The tail fin may comprise a plurality of tail fins. The support may be located between and separate the front section and the rear section. The rear section may be smaller in diameter than the front section. The tail may be located along the longitudinal axis and fixed relative to the body. The plurality of tail fins may be fixedly attached to the end of the tail. The plurality of tail fins may be angled with respect to the longitudinal axis. The plurality of tail fins may be rotatably attached to the end of the tail.

In another exemplary embodiment, the support may be located behind the rear section of the body. The front section and rear section may be formed as a single and continuous body. The wing may comprise a left wing and a right wing both attached relative to the support. The left and right wings may each be pivotably adjustable in a pitch axis relative to the support.

Bowless Arrow:

A bowless arrow is disclosed comprising a shaft defined as including a forward end opposite a rear end. A slider is translatably coupled along the shaft including a front-hand support extending perpendicular to the shaft. A rear-hand grip is located substantially about the rear end of the shaft. A resiliently stretchable bias is attached relative to the slider and either the rear end of the shaft or the rear-hand grip.

An exemplary embodiment may include an arrow tip located at the forward end of the shaft. The arrow tip may comprise an energy dissipating material. Also, a plurality of tail fins may be substantially evenly located about the rear end of the shaft.

Another exemplary embodiment may include a lift-generating wing attached relative to the shaft. The wing may be pivotably adjustable in a pitch axis relative to the shaft. The wing may comprise a dihedral wing that is at or greater than 10 degree or 20 degrees. Furthermore, the wing may comprise a breakaway wing.

In another exemplary embodiment, the arrow tip may comprise a substantially oblate spheroidal or football shape.

Catapult Javelin:

A distance-enhanced throwing toy is disclosed comprising an elongated shaft defined as having a forward end opposite a rear end. A tail fin is located about the rear end of the shaft. A tip is located relative to the forward end of the shaft. An elongated handle is pivotably attached substantially near the forward end of the shaft. The handle is temporarily and securedly biased and pivotable between a first position and a second position. The handle and shaft are substantially parallel in the first position and the handle and shaft are substantially perpendicular in the second position.

In another exemplary embodiment, the tail fin includes a plurality of tail fins substantially evenly located about the rear end of the shaft. The tip may comprise an energy dissipating material.

A bias mechanism may be attached relative to the shaft and handle. The bias mechanism temporarily and securedly biases the handle in the first and second positions. The bias mechanism may comprise an elastomeric material or spring.

In another exemplary embodiment, the tip may comprise a generally oblate spheroidal or football shape.

Cruise Missile:

A throwing and flying toy is disclosed comprising a substantially elongated body including a front portion rotatably attached to a rear portion. A tail fin is located about the rear portion of the body. A lift-generating wing is attached relative to the rear portion of the body. An elongated handle is pivotably attached relative to the front portion of the body. The handle is temporarily and securedly biased and pivotable between a first position and a second position. The handle and body are substantially parallel in the first position and the handle and body are substantially perpendicular in the second position.

In an exemplary embodiment, the wing may be pivotably adjustable in a pitch axis relative to the rear portion of the body. The wing may comprise a breakaway wing or a dihedral wing. Also, the tail fin may be rotatably attached relative to the rear portion of the body.

In another exemplary embodiment, the body may comprise a substantially missile-like shape. Furthermore, the tail fin may comprise a plurality of tail fins substantially evenly located about the rear portion of the body. A tip may be located about the front portion, wherein the tip comprises an energy dissipating material. Alternatively, the tip may comprise a generally oblate spheroidal or football shape.

In another exemplary embodiment, a bias mechanism may be attached relative to the front portion and handle. The bias mechanism may temporarily and securedly bias the handle in the first and second positions. The bias mechanism may comprise an elastomeric band, a rubber band or a spring.

As used herein throughout the entirety of this disclosure: substantially means largely but not wholly that which is specified; plurality means two or more; disposed means joined or coupled together or to bring together in a particular relation; and longitudinal means of, relating to, or occurring in the lengthwise dimension or relating to length.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
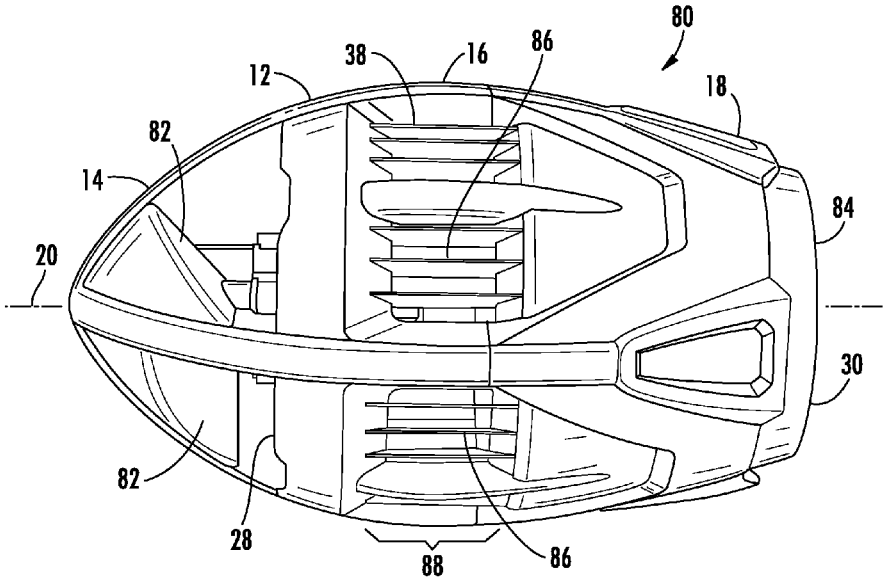
FIG. 1 is a side perspective view of an exemplary self-propelled flying toy embodying one of the present inventions.
Figure 2:
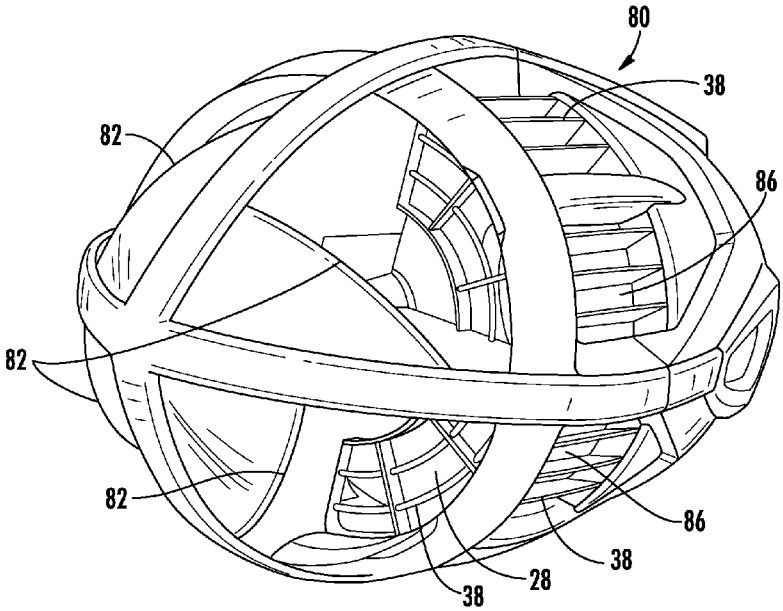
FIG. 2 is a front perspective view of the exemplary embodiment of FIG. 1.

Jetball:

There are several improvements disclosed herein for a self-propelled flying toy 80, herein referred to commonly as the Jetball. In some embodiments, the Jetball may resemble a football and be used in a similar manner for throwing and catching. The improvements to the self-propelled flying toy 80 are a continuation of the developments previously disclosed in application Ser. No. 11/500,749 filed on Aug. 8, 2006 and also the CIP application Ser. No. 11/789,223 filed on Apr. 24, 2007, which are both herein incorporated in full by reference.

Development of the Jetball has resulted in a significant amount of research and development in attempts to make the product function appropriately, let alone make it marketable. Initial prototypes of the Jetball were significantly heavy, as they were on the order of 300-400 grams. These Jetballs used a significant amount of LiPo batteries to generate enough force to make the product interesting and fun to play with. Generating enough thrust to make a noticeable difference was extremely tough for a 400 gram football. Two packs of 3 cell LiPo batteries each at 11.1V and 700 mAh were used wired in parallel. An electric ducted fan intended for radio control ducted fan aircrafts was utilized. The resulting product generated a significant amount of thrust, yet had several problems.

First, the resulting product was actually intimidating. The thrust generated was significant and would sound intimidating while it approached the receiver. Second, the product at the time was still a prototype and it could be somewhat dangerous to catch as the ducted fan blades were not fully protected from a stray finger or two. Third, the resulting product was not very durable, as the significant amount of overall weight became a burden when dropped or simply not caught. The internal components were intended for an RC aircraft, not a football which strikes the ground with a substantial amount of force. It was clear that making a durable production quality version would be extremely challenging. Fourth, the product would ultimately cost too much at retail to be marketable. A new Jetball version was required that would solve these aforementioned problems.

This particular Jetball prototype had to be thrown underhanded if you were right-handed. This was so because the motor and ducted fan happened to rotate in the exact wrong direction for a right-handed thrower. When you throw a football, you initially put a substantial amount of spin on the football to help keep a true trajectory. From the perspective of a right-handed thrower, the football leaves the thrower with a clockwise spin. The internal ducted fan of the prototype would want to spin the football the wrong direction (counterclockwise) for a right-handed thrower. It must be appreciated that the torque imparted on the football body from the ducted fan is quite substantial. Rather than fight the torque, I simply threw the football underhanded as I could easily do such.

It was at this time I noticed something strange but never gave it much thought until later. I noticed a slight tendency for the football to veer to the left when thrown. I noticed it enough that on long throws I would throw the football a bit to the right to compensate for this slight veering affect. The veer was repeatable and would always occur, but I felt the inaccuracy of my hand-made construction or my underhanded throwing technique was to blame. I later learned something unique was happening.

I proceeded to develop the next design iteration of the Jetball. I aimed for an overall weight of about 100 grams. As the overall power levels needed were substantially reduced, so then should the cost be reduced as well. Also, the product would be safer to play with as it would no longer be scary or impose such a great risk from an accidental impact between the ducted fan and a stray finger. I proceeded to develop such a product based off of various toys, rapid prototyping parts and through hand-carved foams and assembly.

This new prototype happened to use motors and ducted fans that were properly geared for a right-hand throw, so I could now toss it overhand. This product was also about 100 grams in weight, or about a fourth to a third of the overall weight of the earlier Jetball prototypes. When I first threw the toy, the Jetball severely turned to the right. At first I thought I was throwing it wrong. However, the more and more I tested it out the more it wanted to repeatedly veer substantially to the right. In fact, it would change direction about 90 degrees. If I wanted a football that could literally be thrown around a corner, I had it. However, this toy would never be marketable if it kept turning in mid air.

I noticed that the latest prototype turned to the right, while the previous prototype turned to the left. This was consistent with the torque effect from the ducted fan of each. I hypothesized that the first product had less of a veer due to the fact that it was heavier. After much research, the phenomenon of gyroscopic precession was discovered. This is a phenomenon which is not intuitive in any way. Gyroscopic precession is when a rotating ducted fan has a force imparted perpendicularly to its rotation. This only happens when the ducted fan is pushing forwards or backwards, and not up and down. When a ducted fan is facing up and down, and therefore pushing up and down, there is no gyroscopic precession affect. It is only when the ducted fan is pushing forwards and backwards in a horizontal direction that gyroscopic precession causes a perpendicular force to twist the aircraft in flight.

All ducted fan driven airplanes and propeller driven airplanes suffer from gyroscopic precession. Usually the speed of the aircraft and the interaction between the air and the flight control surfaces are such that the effect is negligible. However, on my 100 gram Jetball the effect was severe. Pilots, whether for radio control aircraft or for real aircraft, are taught that when performing a slow stall turn the aircraft will naturally rotate much more easily one direction as compared to the other. This is due to gyroscopic precession. One may have noticed that approaching aircraft seem to always be slightly angled one direction or the other when taking off and landing. It is easy to chalk this up to a slight breeze, but it is more likely the natural tendency of gyroscopic precession to want to twist the aircraft while in flight.

I had to find a solution to the problem. I tried everything I could think of. I tried shifting the center of gravity of the football forward and backward, yet it made no difference. I tried adding on a significant tail section and tail fins to force the football to go straight, yet it made little difference. After two weeks of trial and error, I cut out balsa wood sections and created an angled nose section that crudely resembled a ducted fan. In essence the front of the ball resembled a ducted fan, as crude as it was, while still retaining a football like shape. Low and behold when I threw the football, it veered the other direction! I knew instantly that I invented a fix.

The solution to making a self-propelled flying toy 80 fly straight is to create a front section 14 that is angled similar to FIGS. 1-4. The front section 14 acts like a ducted fan and creates an equal and opposite gyroscopic precession affect that cancels out the gyroscopic precession affect from the ducted fan 22. In my prototypes and figures herein, I used and show four angled surfaces 82 that comprise the angled intake. If you make the angle intake too severe, the toy 80 will veer to the left. If you make the angle intake not severe enough, the toy 80 will veer to the right. This also means that counter-rotating blades will eliminate gyroscopic precession, but then that requires a more complicated gearing and ducted fan design and assembly. In the instant design, using four angled surfaces 82 happens to work well in matching the four sides of a traditional football such that the angled intake shapes are not strange looking or out of place. In fact, the design is so seamless that few who use the product will ever recognize the angled surfaces 82 as a correction for a gyroscopic precession problem.

With reference to the following FIGS. 1-5, the numbering is consistent with and is a continuation from the previously filed application Ser. No. 11/500,749 filed on Aug. 8, 2006 and also the CIP application Ser. No. 11/789,223 filed on Apr. 24, 2007, both of which are fully incorporated herein. A self-propelled flying toy 80 is disclosed comprising a body 12. The body 12 is defined as including a front section 14, a center section 16 and a back (rear) section 18 each along a longitudinal axis 20. A ducted fan 22 is located within the body 12 substantially centered about the longitudinal axis 20. A motor 24 is mechanically coupled to the ducted fan 22. The motor 24 may be an electric motor similar to the previous applications (Ser. Nos. 11/500,749 and 11/789,223) or may now be an internal combustion engine. The reference to a motor 24 as used in this instant application is not specific to particular type of motor, unless further specified in the claims. A power source 26 is coupled to the motor 24. The power source 26 may be an electrical power source similar to the previous applications (Ser. Nos. 11/500,749 and 11/789,223) or comprise a combustible fuel for an internal combustion engine. The reference to a power source 26 as used in the instant application is not specific to a particular type of power source, unless further specified.

At least two angled surfaces 82 are fixed relative to the body 12 and located substantially within the front section 14. Each of the at least two angled surfaces 82 are evenly centered about the longitudinal axis 20 and facing an opposite thrust-generating rotational direction relative to the ducted fan 22. As the ducted fan 22 spins, it causes the body 12 to spin in the opposite direction. Thrust is generated by the ducted fan 22, but thrust is also generated by angled surfaces 82 of the body 12. The gyroscopic precession from the ducted fan 22 is then canceled by the equal and opposite gyroscopic precession from the angled surfaces 82. As can be understood, the angled surfaces 82 must be facing a particular direction as to create thrust when the body 12 rotates. This is opposite the way the surface of the ducted fan blades must be angled, as the ducted fan 22 rotates in an opposite direction as compared to the body 12.

As shown in FIGS. 1-4, there are a total of four angled surfaces 82. It is to be understood by one skilled in the art that a range of a number of angled surfaces 82 can be used. For instance 2, 3, 4, 5, 6, or a plurality of angled surfaces 82 can be used to counter the gyroscopic precession from the ducted fan 22. It is to be understood that at least two angled surfaces 82 are required to create an opposite gyroscopic precession affect. Furthermore, the angled surfaces 82 may also be in airflow communication with the air-inlet 28 and ultimately the ducted fan 22. As air enters the toy 80 it first interacts with the angled surfaces 82. Air can then pass through the air-inlet 28 and an air-permeable structure 38. Air can then interact with the ducted fan 22 and is propelled out the air-outlet 30 and out another air-permeable structure 38.

The particular embodiment of the flying toy 80 in FIGS. 1-5 is made from Expanded Polypropylene (EPP) and ABS plastic to achieve its target weight of 100 grams. This means the toy 80 is sufficiently light but also more fragile than a typical football. This exemplary embodiment of the toy 80 is not meant to be played with in an overly rough or potentially destructive manner, such as tackle football or being kicked. However, a problem arises when the toy 80 closely resembles a football. If it looks like a football, the odds are great that a user will try to play with it as such and risk damaging the toy 80. Therefore, it is reasoned that some variation of styling might be invented such that the toy 80 would look different enough from a football as not to instigate such rough usage.

Figure 3:
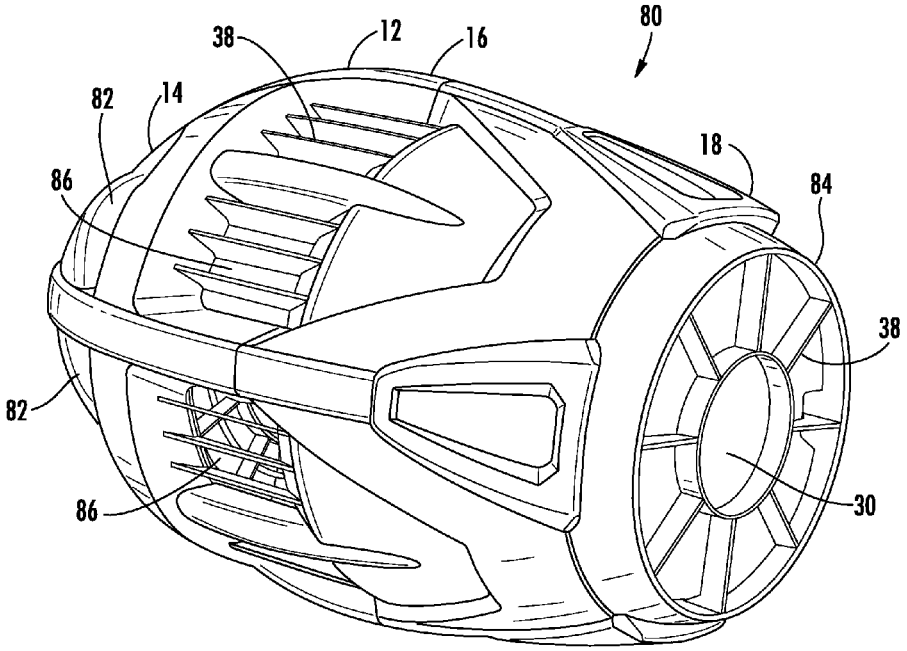
FIG. 3 is a rear perspective view of the exemplary embodiment of FIG. 1.

Accordingly, in an exemplary embodiment the oblate spheroidal body 12 may truncated perpendicular to the longitudinal axis 20 located substantially about the back section 18 resulting in a truncated end 84. FIGS. 1 and 3 best show the truncated end 84. The body 12 now has more of a bullet-like shape with a curved front section 14 and a flat (truncated) back section 18. The body 12 is still sufficiently curved and sized such that a user is able to grasp the toy 80 within their hands and throw the toy 80 in a spiral motion, similar in how a football can be thrown. It is to be understood by one skilled in the art that the body 12 can be formed in a variety of shapes which are still able to be thrown and caught, and this disclosure is not intended to limit it to the precise form described and shown herein. For instance the toy 80 can be styled similar to a bullet, a missile, a football or any combination thereof.

FIG. 3 shows how the air-permeable structure 38 can be integrated into the air-outlet 30 such that it keeps fingers away from the ducted fan 22. In this particular embodiment the air-outlet 30 has an air-permeable structure 38 which is formed from an injection molded plastic. The plastic structure 38 fits within the rear section 18 of the air-outlet 30 and helps to add strength and stability to the overall toy 80.

The size of the air-outlet 30 is also critical. It was discovered during thrust testing of different air-outlet 30 designs that making a smaller diameter air-outlet 30 resulted in a significant amount of loss thrust. It was found that the air-outlet 30 should be substantially around 3.5 inches in diameter or greater for a ducted fan 22 that is substantially about 4 inches in diameter. If the air-outlet 30 is sized too small, thrust is actually retarded significantly as air tries to come out the air-inlet 28.

To develop the powerplant (motor, battery, gearing, ducted fan) of the Jetball, a bench powerplant was devised. This bench powerplant was mounted upon a digital scale and pointed directly upwards. In other words, a ducted fan was pointed upwards such that it was thrusting downwards on the scale when in operation. The scale would be zeroed right before a thrust test to then determine how much thrust a particular powerplant was producing. This was needed as there are an endless variety of ducted fan sizes and shapes, motors, gearing and RC battery types that could be utilized.

One such exemplary embodiment of a powerplant combination utilized the tail rotor from a RC helicopter (like the Piccolo Helicopter tail rotor prop) cut down to about 4 inches in diameter, a 12 mm diameter motor from GWS-EDF-50 that was rated for 6-7.2 volts, a gearing ratio of about 3:10 and a LiPo battery of 7.4 Volts and about 300 mAh. This combination produced about 100 grams of thrust and was found to be a suitable for this application. The smaller gear 90 attaches to the motor 24 and the larger gear 92 attaches to the ducted fan 22. The smaller gear 90 has 12 teeth and a pitch diameter of 6 mm. The larger gear 92 has 40 teeth and a pitch diameter of 20 mm.

While this powerplant worked well without any structure around it, a test diameter of foam was slowly lowered over and around the fan while it ran. The test diameter of foam was about 4.5 inches in diameter, just enough to slip over the rotating ducted fan. As the test diameter of foam approached the ducted fan, the sound and pitch of the ducted fan changed, and surprisingly the thrust produced dropped significantly. Through trial and error, it was determined that when an outer diameter structure is placed within either 0.5 inches ahead of the ducted fan or 0.5 inches behind the ducted fan, the thrust levels would be dramatically reduced.

Therefore, to increase performance of the toy 80 an exemplary embodiment may include an auxiliary air-inlet 86 (also called a hover vent or cheater vent) located substantially within the center section 16 about the longitudinal axis 20 in airflow communication with the ducted fan 22. The auxiliary air-inlet 86 may comprise a plurality of auxiliary air-inlets 86. The plurality of auxiliary air-inlets 86 may each define an aperture 88 extending substantially about 0.5 inches or greater ahead and 0.5 inches or greater behind the ducted fan 22 in a direction along the longitudinal axis 20. Furthermore, the air-inlet 30, the auxiliary air-inlet 86 and the air-outlet 30 may each include an air-permeable structure 38. The auxiliary air-inlets 86 may also be shaped to help channel air into the ducted fan 22 as the body 12 spins. Each portion or span of the air-permeable structure 38 for the auxiliary air-inlets 86 is angled to help channel and direct air inwards to the ducted fan 22. The auxiliary air-inlets 86 can be fashioned in a multitude of ways. FIGS. 1-4 show that the auxiliary air-inlets are divided into four main sections placed about the circumference of the body 12 about the center section 16. It is to be understood by one skilled in the art that a multitude of different designs for the auxiliary air-inlets 86 may be fashioned and this disclosure is not limited to any particular embodiment or teaching.

The self-propelled flying toy 80 can be activated in a multitude of ways and methods previously taught in application Ser. No. 11/500,749 and application Ser. No. 11/789,223. In short, a centrifugal switch 94 may be disposed within the body 12 detecting rotation about the longitudinal axis 20. The centrifugal switch 94 regulates operation of the ducted fan 22, wherein the ducted fan 22 is powered when rotation about the longitudinal axis 20 is detected and not powered when rotation about the longitudinal axis 20 is not detected. Said differently, another embodiment may include a means for automatic activation and deactivation of the motor 24 by detecting an in-flight condition and a not-in-flight condition, wherein such means is located within the body 12 and in communication with the motor 24 and power source 26. Also, these embodiments may include a timer 96 located within the body 12 in communication with the motor 24 and power source 26, wherein the motor 24 after activation will automatically turn off after a predetermined time.

Figure 4:
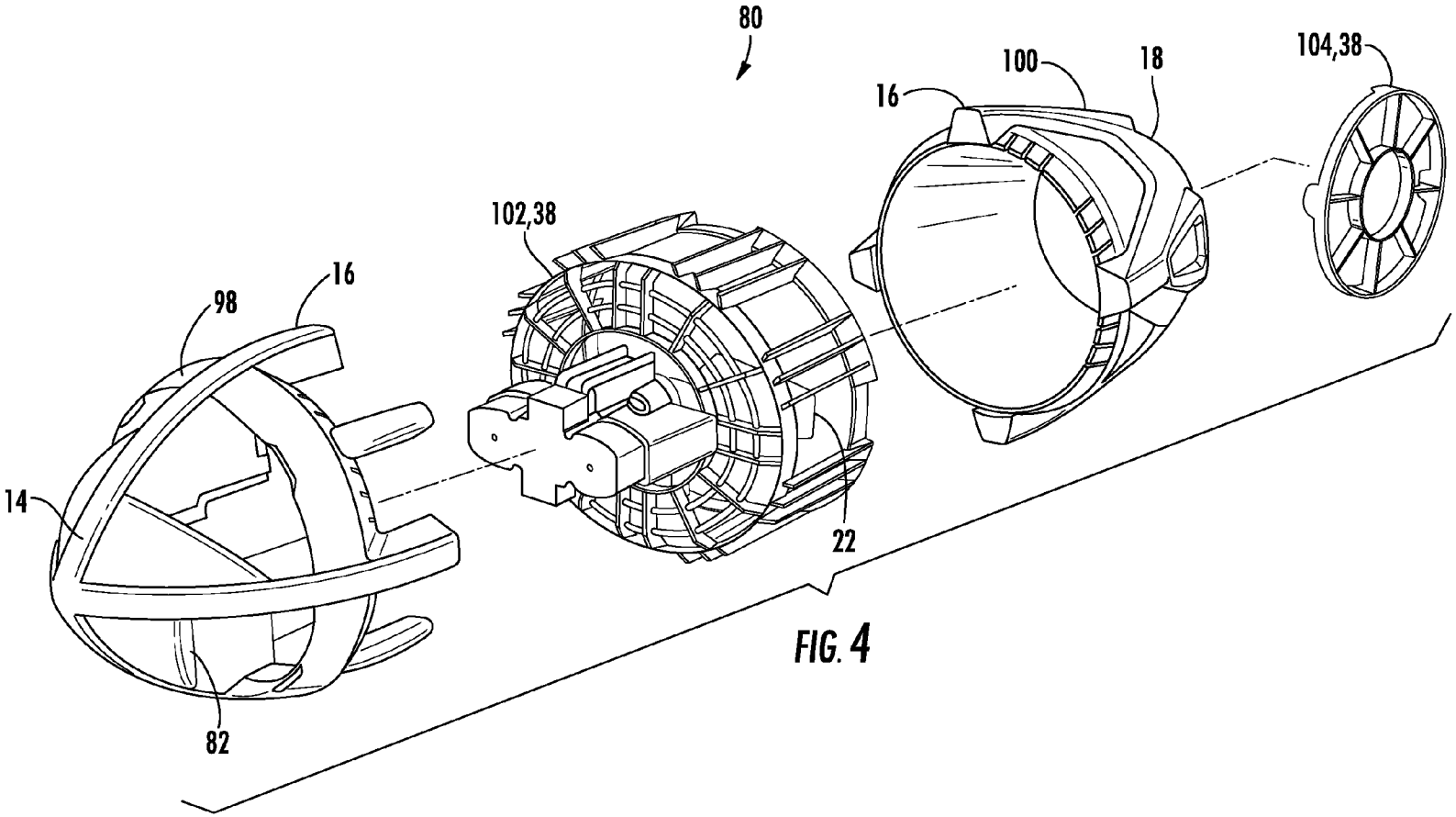
FIG. 4 is an exploded front perspective view of the exemplary embodiment of FIG. 1.

FIG. 4 shows how one embodiment may be constructed. A first section 98 may be made of EPP foam or some other comparable resilient material. The foam should be about 1.4 lbs per square inch, to keep the weight down. The first section 98 includes the front section 14 and half of the center section 16. A second section 100 may also be made of EPP foam or some other comparable resilient materials. The first section 98 and the second section 100 make up a majority of the body 12 of the toy 80. It can be seen that when the two sections 98 and 100 are joined, they form the body 12 of the toy 80. A first plastic screen 102 forms the air-permeable structure 38 that prevents fingers from entering the air-inlet 28 of the auxiliary air-inlet 86. When the first section 98 is joined with the second section 100, it captures in place the first plastic screen 102. Also, a second plastic screen 104 can be attached to the rear of the second section 100 which acts as an air-permeable structure 38 about the air-outlet 30.

Figure 5:
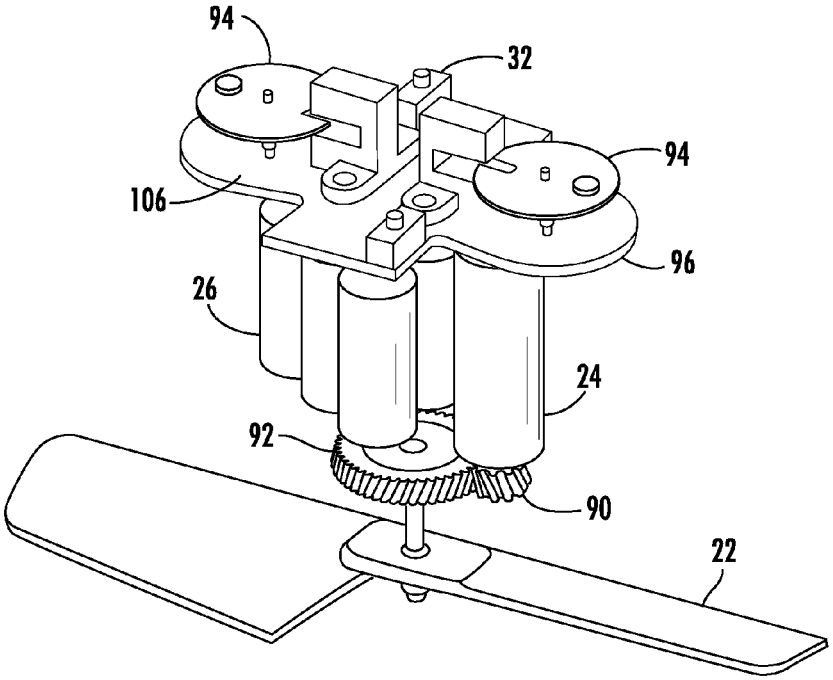
FIG. 5 is a perspective view of an exemplary embodiment of a powerplant assembly of FIGS. 1-4.

FIG. 5 shows more detail of the exemplary powerplant used within the toy 80. The motor 24 is mechanically coupled to the ducted fan 22 through a smaller gear 90 and a larger gear 92. The power source 26 supplies energy to the motor 24. The smaller gear 90 is directly attached to the motor 24 and the larger gear 92 is directly attached to the ducted fan 22. It is to be understood that a variety of gearing or directly-driven ducted fans 22 may be utilized. An electrical board 106 can include the centrifugal switches 94, an on-off switch 32, or other switches required to make the toy 80 operate. The electrical board 106 is wired to control the flow of energy from the power source 26 to the motor 24.

Although several embodiments of and improvements to the self propelled flying toy 80 have been described in detail for purposes of illustration, various modifications may be made to each without departing from the scope and spirit of the invention. Accordingly, the invention is not to be limited, except as by the appended claims.

PropRockets:

Development of the PropRocket led from development of the Jetball, as the two products are capable of sharing a multitude of similar parts. Accordingly, the information disclosed in the Jetball is directly applicable and incorporated into the PropRocket disclosure without repetition.

Figure 6:
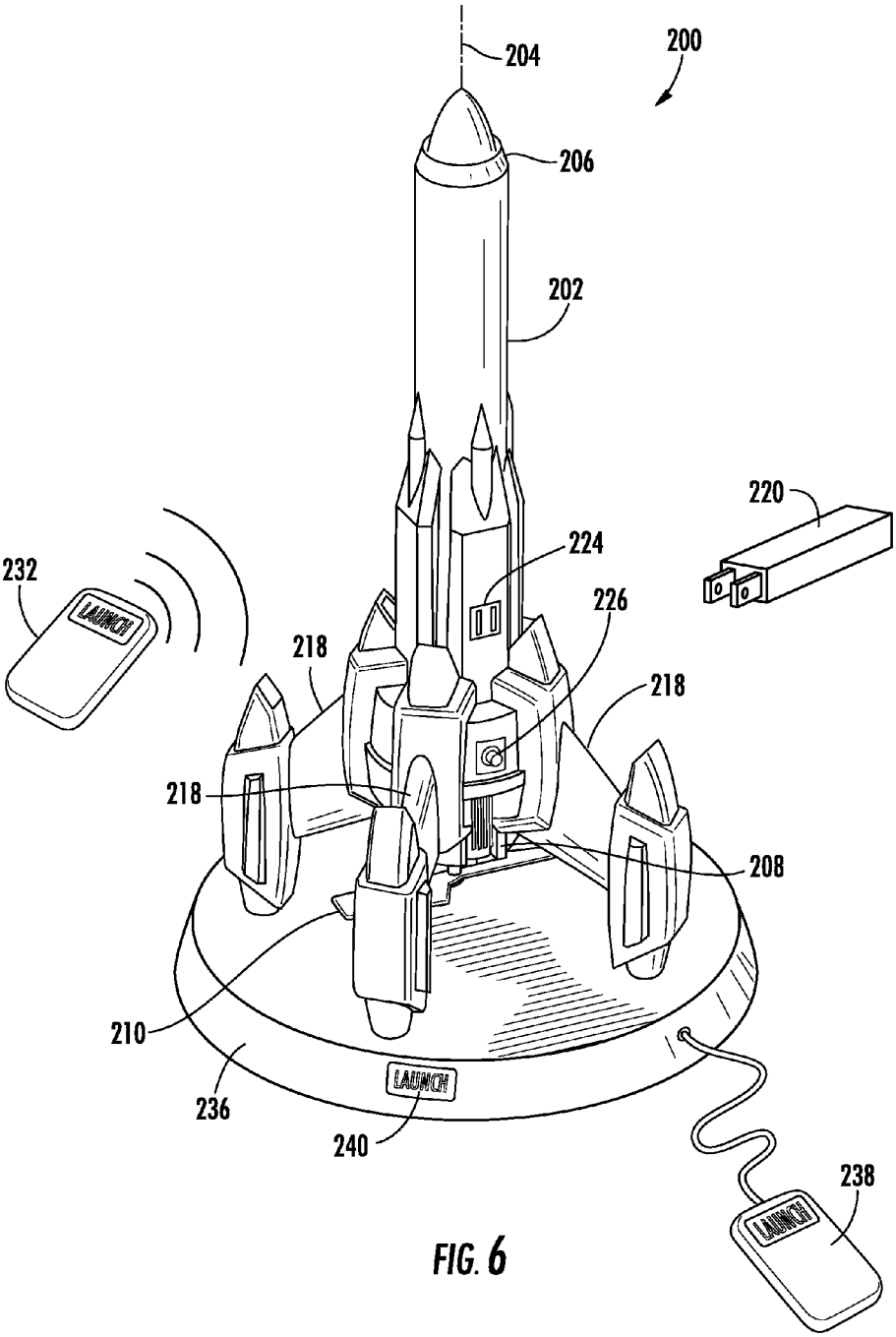
FIG. 6 is a perspective view of an exemplary self-propelled rocket toy embodying one of the present inventions.
Figure 7:
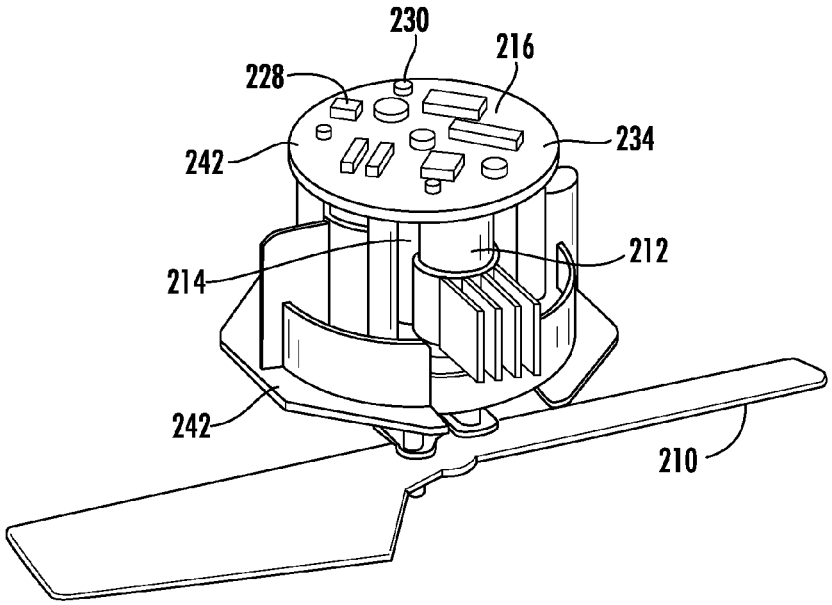
FIG. 7 is a perspective view of a powerplant assembly for the exemplary embodiment of FIG. 6.
Figure 8:
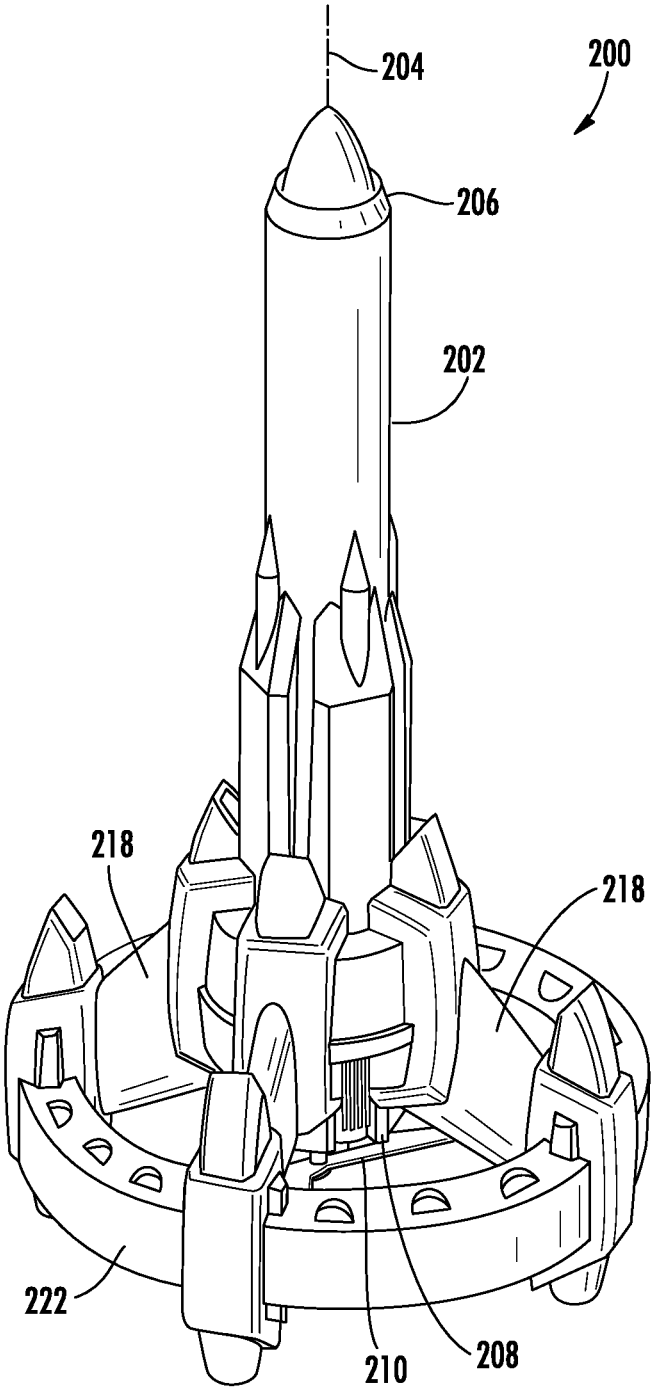
FIG. 8 is a perspective view of another exemplary self-propelled rocket toy body embodying one of the present inventions.

Referring now to FIGS. 6-8, a self-propelled rocket toy 200 is disclosed comprising a substantially elongated body 202 located about a longitudinal axis 204 which is defined as including a top end 206 opposite a bottom end 208. A propeller 210 is substantially centered about the longitudinal axis 204 located about the bottom end 208. An electric motor 212 is mechanically coupled to the propeller 210. A power source 214 is electrically coupled to the electric motor 212. An activation mechanism 216 is electrically coupled to the electric motor 212 and power source 214. In various exemplary embodiments the power source 214 may comprises a rechargeable battery, such as a NiCad, NiMh, or LiPo battery. Alternatively, the power source 214 may comprise a capacitor.

While using the same Jetball powerplant worked well for the prototype of the PropRocket, in production it may be better to use a capacitor in place of a battery. A capacitor is significantly cheaper than a LiPo battery, or even a NiMH or NiCAD battery. Batteries store energy chemically, whereas a capacitor stores electrical energy in the electrical form. While a capacitor can be charged and discharged quickly, it will also lose its stored energy over time very rapidly. However, the play pattern of the PropRocket lends itself to a charge and launch play pattern. This means that an external and auxiliary charger 220 can be used to quickly charge the capacitor. For instance, the auxiliary charger 220 can be plugged into a charger port 224 located on the body 202. Once charged the PropRocket can be immediately launched fully expending its stored energy. The PropRocket will fall to the earth to simply be recharged again and again.

Another exemplary embodiment of the self-propelled rocket toy 200 may include at least three supports 218 outwardly extending from and fixed relative to the body 202. Each support 218 is substantially evenly spaced about the longitudinal axis 204 and extending below the propeller 210. Now referring to FIG. 8, a ring 222 may be located about the longitudinal axis 204 and around the propeller 210 connected to the at least three supports 218. The supports 218 help to provide a foundation for the toy 200 and help to keep the propeller 210 away from striking the ground. The supports 218 and ring 222 work together to provide protection from the spinning propeller 210. An air-permeable structure similar to the Jetball can be integrated into the supports 218 and ring 222, however it is thought unnecessary considering the toy 200 doesn't interact with the hands as much as the Jetball does during throwing and catching.

In another exemplary embodiment not shown, the supports 218 may be lift-generating devices each angled at an opposite thrust-generating rotational direction relative to the propeller 210. As the propeller 210 spins, it causes the body 202 to spin in the opposite direction. Thrust can be gained by forming the supports 218 to generate lift either by creating a wing-profile or angling the supports 218.

There are a multitude of methods or ways the self-propelled rocket toy 200 can be launched. In one exemplary embodiment, the activation mechanism 216 may comprise a launch button 226 located relative to the body 202 and in communication with the electric motor 212 and power source 214. After pressing the launch button 226, a countdown can be started and displayed either visually through LEDs or through a speaker projecting a countdown. A timer 228 may also be located within the body in communication with the electric motor 212 and power source 214, wherein the electric motor 212 after activation will automatically turn off after a predetermined time. The timer 228 can be adjusted to turn the motor 212 off at different intervals which correspond to different heights achieved during flight.

In another exemplary embodiment, the activation mechanism 216 may comprise a receiver 230 disposed within the body 202 and including a remote launch transmitter 232 for remotely activating the electric motor 212 and propeller 210.

In another exemplary embodiment, the activation mechanism 216 may comprise a stand 236 that the toy 200 is placed upon. The stand 236 can resemble a full size launch pad or other stylistically appeasing forms. The stand 236 can incorporate the charging mechanism either from batteries or a wall mounted plug. Once the toy 200 is charged, it can be activated from a tethered launch button 238 or a launch button 240 located on the stand 236.

A new and unique way to activate the rocket toy 200 is to manually launch it from a person's hand by spinning the body 202 in the air. While it is commonly known to spin a football in flight, it is not commonly known or thought of to spin a rocket in flight. In this exemplary embodiment, the activation mechanism 216 may comprises a centrifugal switch 234 disposed within the body 202 and in communication with the electric motor 212 and power source 214, wherein the centrifugal switch 234 is configured upon detecting rotation about the longitudinal axis 204 to activate the electric motor 212 and propeller 210. This embodiment is directly similar to the activation methods disclosed for the Jetball, as all activation methods of the Jetball are applicable to the PropRocket and are incorporated herein. Said differently, the activation mechanism 216 may comprise a means for automatic activation and deactivation of the motor 212 by detecting an in-flight condition and a not-in-flight condition, wherein such means is located within the body 202 and in communication with the electric motor 212 and power source 214. A timer 228 may be located within the body 202 in communication with the motor 212 and power source 214, wherein the motor 212 after activation will automatically turn off after a predetermined time.

FIG. 7 is a perspective view of a powerplant assembly showing how a frame 242 can be made to connect the motor 212 and the power source 214. An electrical board 244 is mounted to frame 242 and can include the activation mechanism 216. The frame 242 is designed to be slide within and connect to the bottom end 208 of the elongated body 202. The electrical board 244 can include any necessary electronic components, including the charger port 224, the launch button 226, or any other switches such as an on/off switch, LED lights or even a small speaker for sounds and countdowns. A heat sink may be attached to the motor 212 to dissipate heat energy in the motor 212 from repeated use. The heat sink shown herein comprises four surfaces that interact with air. Furthermore, the heat sink may be used in any of the toys herein utilizing a motor or the like.

The PropRocket must be properly balanced to achieve a controlled and straight flight upwards. Initial prototypes were wobbly and erratic while flying upwards. After trial and error, three dimes were placed on the inside of the lower foam ring 222. The PropRocket instantaneously flew perfect. This means that a certain amount of mass placed at a distance away from the propeller 210 and below the propeller 210 helps to stabilize the flight characteristics. In fact, one exemplary embodiment might allow the user to selectively place coins in premade receptacles to adjust flight characteristics.

The outside ring 222 can act as a safety feature helping to keep fingers away from the rotating propeller 210. The outside ring 222 can also be deleted as shown in FIG. 6 to then allow the PropRocket body 202 to better imitate a real rocket. As can be imagined by one skilled in the art, there are an endless amount of variations that can be fashioned to create a line of different rocket bodies.

Other exemplary embodiments of the PropRockets are possible. For instance, a glider PropRocket could be devised such that once the PropRocket reaches its apex, the motor deactivates and the PropRocket glides back to the ground. It would be beneficial if the glide path was somewhat circular such that the PropRocket would come down in about the same place as when it was launched. Another exemplary embodiment is to include a deployable parachute that activates once the PropRocket reaches its apex. Another exemplary embodiment is to create an RC glider from the PropRocket. The PropRocket would launch like a PropRocket, but once it reached the apex it could be controlled through a radio transmitter and receiver setup. A payload series PropRocket is yet another exemplary embodiment where the PropRocket would carry a payload to the apex and then detach. For instance, the detachable portion could be a glider, an RC glider, a parachute or any other deployable payload. As can be seen by one skilled in the art and from this disclosure, there are a multitude of PropRocket variations that could be devised.

Although several embodiments of the self-propelled rocket toy 80 have been described in detail for purposes of illustration, various modifications may be made to each without departing from the scope and spirit of the invention. Accordingly, the invention is not to be limited, except as by the appended claims.

Flying Football:

Referring now to FIGS. 9-20, a throwing and catching flying toy 300 is commonly referred to either as the Flying Football, the Wing-It Football or the Gliding Football. The throwing and catching flying toy 300 comprises a structural support 302 including a lift-generating wing 304 attached relative to the support 302. A body 306 is rotatably attached relative to the support 302, wherein the body 306 comprises a front section 308 fixed relative to a rear section 310. Both the front section 308 and rear section 310 rotate about a longitudinal axis 312. A tail 314 is located relative to either the support 302 or the body 306 extending in a direction beyond the rear section 310 of the body 306. A tail fin 316 is attached relative to a tail end 318.

In exemplary embodiments, the body 306 may comprise a generally oblate spheroidal or football shape. It is also to be understood that the body 306 can be formed to resemble other various shapes, such as missile, rockets or other combinations thereof. The rear section 310 is formed such that a person can grasp the toy 300 within their hand and then throw the toy 300 in a similar motion in how a football is thrown. The front section 308 is formed such that it is easy to catch, in a similar manner as to how a football is caught.

Figure 9:
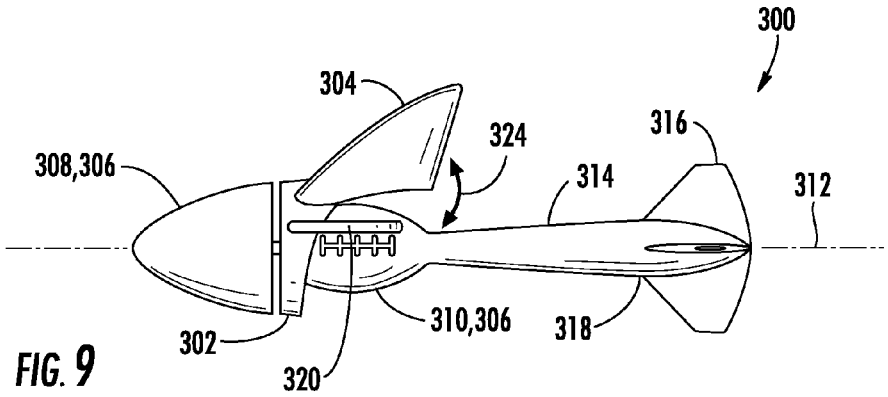
FIG. 9 is a side view of an exemplary throwing and catching flying toy embodying one of the present inventions.
Figure 10:
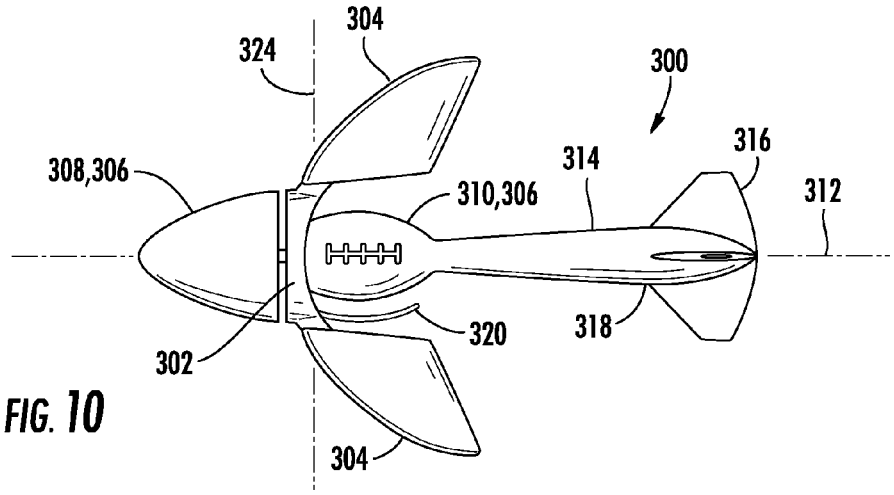
FIG. 10 is a top view of the exemplary embodiment of FIG. 9.
Figure 11:
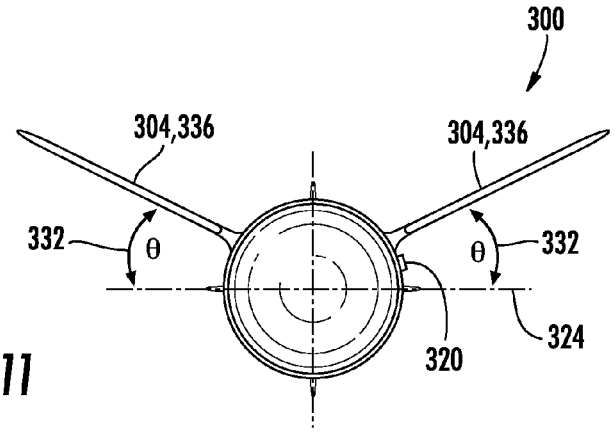
FIG. 11 is a front view of the exemplary embodiment of FIG. 9.
Figure 12:
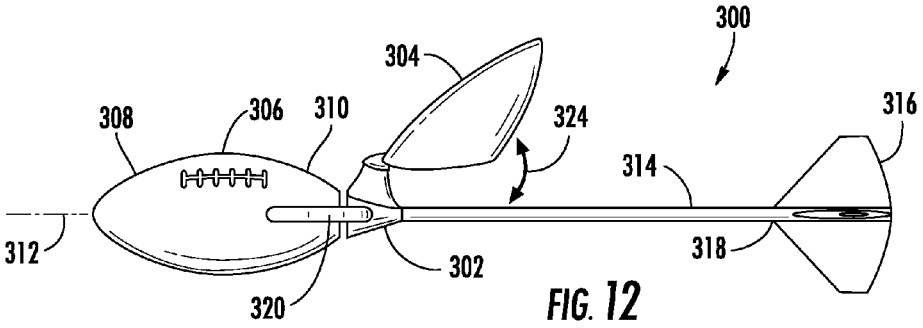
FIG. 12 is a side view of another exemplary throwing and catching flying toy embodying one of the present inventions.
Figure 13:
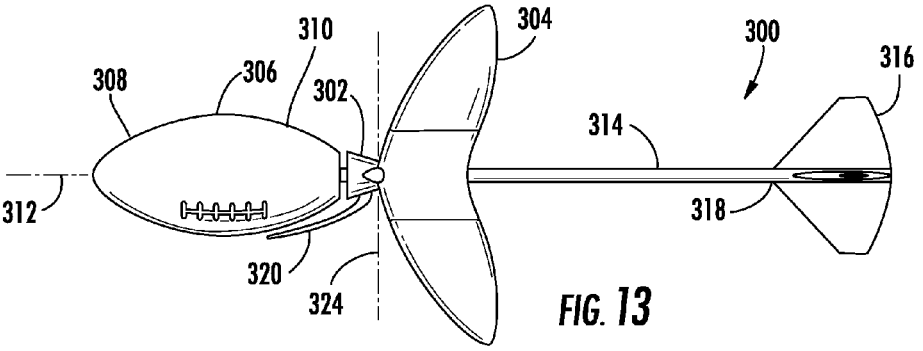
FIG. 13 is a top view of the exemplary embodiment of FIG. 12.
Figure 14:
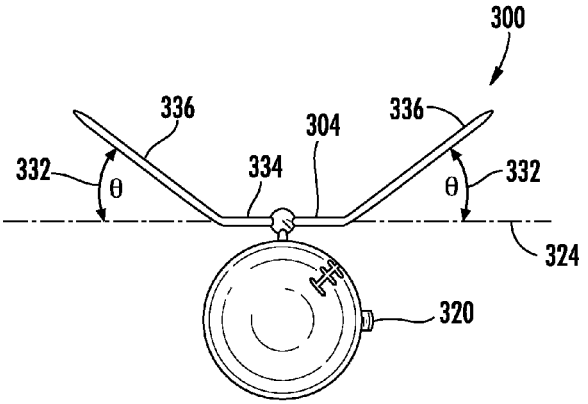
FIG. 14 is a front view of the exemplary embodiment of FIG. 12.
Figure 15:
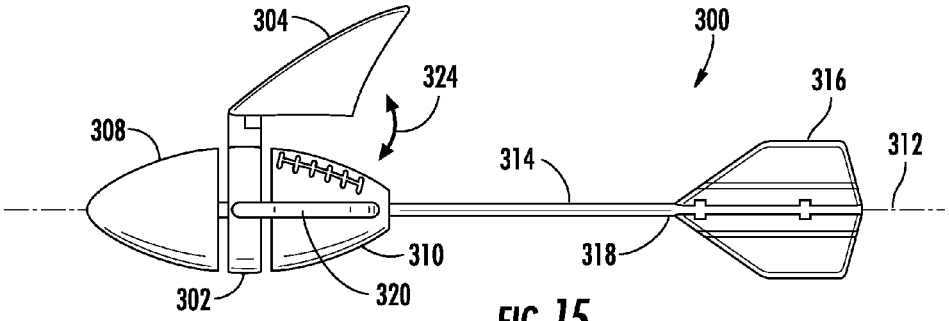
FIG. 15 is a side view of another exemplary throwing and catching flying toy embodying one of the present inventions.
Figure 16:
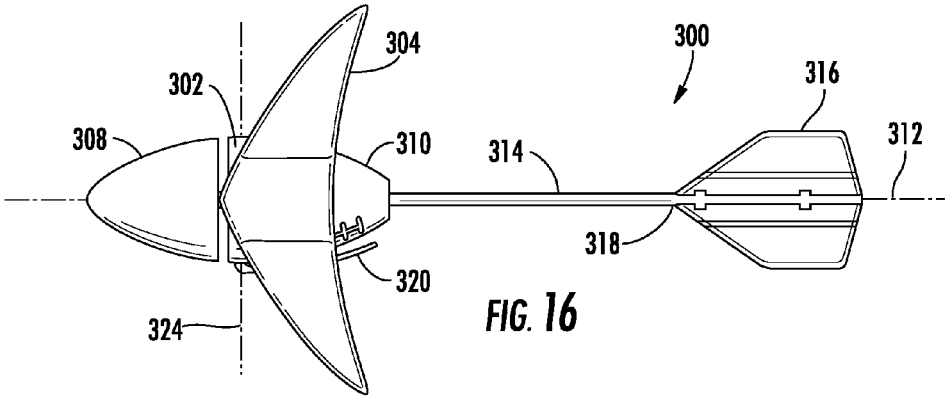
FIG. 16 is a top view of the exemplary embodiment of FIG. 15.

In some embodiments, as shown in FIGS. 12-14, the front section 308 and rear section 310 may be formed as a single body 306. In other embodiments, as shown in FIGS. 9-11 and 15-18, the front section 308 may be formed separate from the rear section 310, while the sections are still fixedly connected. More specifically, the support 302 may be located between and separate the front section 308 and the rear section 310. In some embodiments, as shown in FIGS. 9-11, the rear section 310 may be smaller in diameter than the front section 308. This is so because it is easier to grasp a smaller diameter rear section 310 for throwing, and it is also easier to catch a larger front section 308 when catching the toy 300. In another embodiment, as shown in FIGS. 15-18, the front section 308 and rear section 310 are the substantially the same diameter such that the transition between the sections does not vary in shape and diameter.

Figure 18:
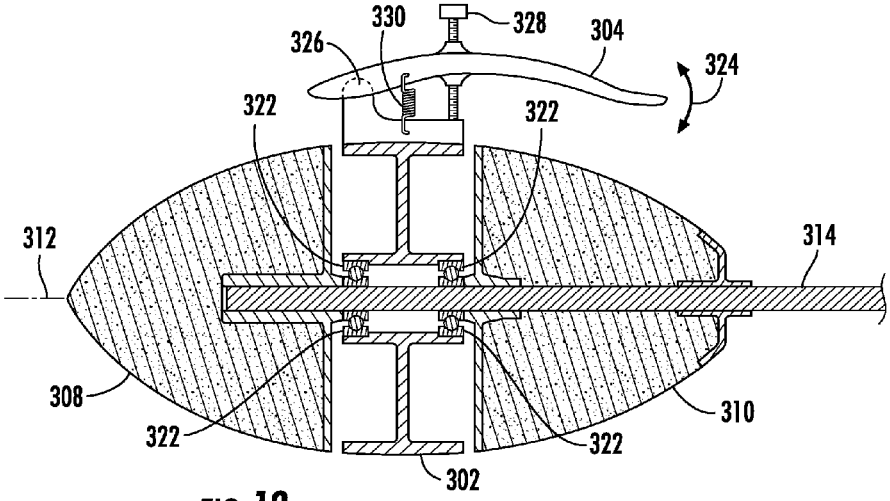
FIG. 18 is an enlarged cross-sectional view of the main body of the exemplary embodiment of FIG. 15.

The body 306 is rotatable with respect to the support 302. This is most easily accomplished with a bearing 322. It has been found that the bearing 322 should be of a very low friction. This can be accomplished with a relatively loose fitting roller ball bearing which does not have grease. Grease imparts enough friction that the body 306 does not freely rotate. Other low friction bearings are suitable replacements if the friction of the bearing is low enough. The bearing 322 is most easily seen in FIG. 18. FIG. 18 shows how the bearing 322 allows the front section 308 and rear section 310 to rotate freely about the support 302.

A thumb grip 320 may be fixed relative to the support 302 and located along and adjacent to the rear section 310 of the body 306. The thumb grip 320 is shaped and formed such that a user's thumb presses the thumb grip 320 while the toy 300 is held. Due to the low friction of the bearing 322, the structural support 302 and wing 304 would rotate when the toy 300 was held before a throw. The thumb grip 320 allows the body 306 to be temporarily fixed relative to the support 302. Once the toy 300 is in the air, the thumb grip 320 is released and the body 306 is able to rotate freely. In the various embodiments, the thumb grip 320 extends from the support 302 and is positioned just above the rear section 310. In FIGS. 9-11 and 15-17 the thumb grip 320 starts at the support 302 and moves rearward over the rear section 310. In FIGS. 12-14 the thumb grip 320 starts at the support and moves forward over the rear section 310. The thumb grip 320 is also positionable on either side of the support 302 such that it can be used for either a right-handed thrower or a left-handed thrower. Additionally, the thumb grip 320 can be positioned at various locations on each side of the support 302 such that it can be sized for people of varying hand sizes. For instance, an adult has a larger hand and might want to move the thumb grip 320 further over as compared to a child with a smaller hand.

In an exemplary embodiment, the wing 304 may be pivotably adjustable in a pitch axis 324 relative to the support 302. Adjusting the pitch of the wing 304 is necessary to trim the toy 300 in flight. If the pitch is too great, the toy 300 may fly in an upward arc and then stall before it reaches the intended receiver. If the pitch is too less, the toy 300 may fly downwards and crash into the ground prematurely. The right amount of pitch is necessary such that the toy 300 can fly in a long and straight flight path.

To achieve this adjustability the wing 304 may be pivotably adjustable with respect to the structure 302. FIG. 18 best shows how this pivotable adjustment could operate, as there are a multitude of methods one skilled in the art could devise. The wing 304 is pivotable about a pivot 326. The wing 304 is biased against the pivot 326 by a bias 330, or also a spring means or a rubber band. The pitch of the wing 304 is therefore adjusted by a screw 328. As the screw 328 threads into the wing 304, it causes the whole wing 304 to either pitch up or pitch down relative to the support 302. The toy 300 can be thrown and adjusted to achieve the right amount of overall pitch.

Another feature of the design of FIG. 18 is that the wing 304 can also be a breakaway wing 304. This means that the wing 304 can come apart from the support 302 and be easily replaced. For instance, when the toy 300 crashes, a wing that is fixedly attached might snap and break. To prevent this, the wing 304 is held in place with the bias 330. When the bias 330 is overcome, the wing 304 simply comes apart from the support 302. Then the wing 304 can be reattached to the support 302 for further play. It is to be understood by one skilled in the art that a multitude of designs can be devised where the wing 304 is breakaway and this disclosure is not intended to limit it to the precise form described and shown herein.

Figure 17:
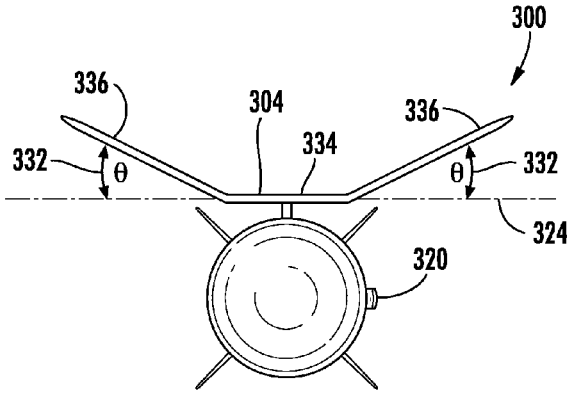
FIG. 17 is a front view of the exemplary embodiment of FIG. 15.

Another feature of the exemplary embodiments may incorporate a wing 304 that has an amount of dihedral built in. Dihedral is best shown in FIGS. 11, 14, and 17. The dihedral angle 332 is a measure of the angle between the wing that is horizontal and the wing that is angled upwards. A wing that has an amount of dihedral built into it is inherently stable. As one side of a wing tips downward and becomes more aligned along a horizontal plane, it essentially generates more lift, which then causes it to rise. Dihedral helps to keep the toy 300 flying level and causes the support 302 and the wing 304 to remain upright while the rest of the body 306 rotates during flight. The wing 304 may be broke apart into two separate halves as is shown in FIGS. 9-11, or the wing 304 may comprise one single wing 304 with a horizontal section 334 joined by two dihedral sections 336 as is shown in FIGS. 14-17. The dihedral angle 332 can be a variety of angles, such as 10 degrees or 20 degrees. The more the dihedral angle 332, the more stability is increased while an amount of overall lift is lost.

Another feature of the exemplary embodiments is placing the wing 304 above the center of gravity of the toy 304 or above the longitudinal axis 312. By placing the wing 304 above the center of gravity, it makes the toy 300 inherently stable. Placing the wing 304 below the longitudinal axis or below the center of gravity would make the toy 300 inherently unstable. The high placement of the wing 304 combined with the dihedral angle 332 makes the toy 300 stable in flight.

The tail 314 can extend rearward from either the support 302 as shown in FIGS. 12-14, or the tail 314 can extend from the rear section 310 of the body 306 as shown in FIGS. 9-11 and 15-18. When the tail 314 extends from the support 302, the tail 314 is stationary in that it doesn't rotate with the body 306. When the tail 314 extends from the rear section 310 of the body 306, the tail 314 rotates with the body 306.

Figure 19:
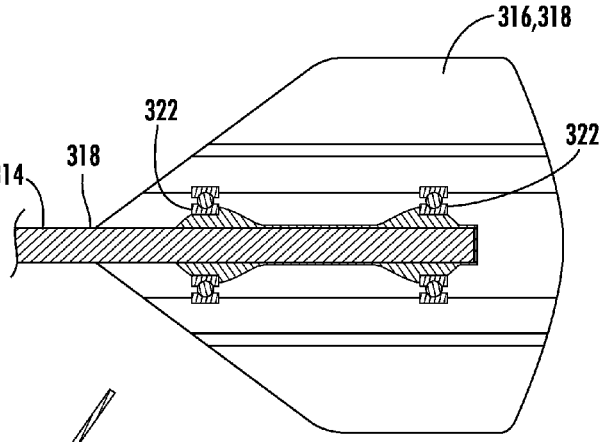
FIG. 19 is an enlarged cross-sectional view of the tail and tai fin of the exemplary embodiment of FIG. 15.
Figure 20:
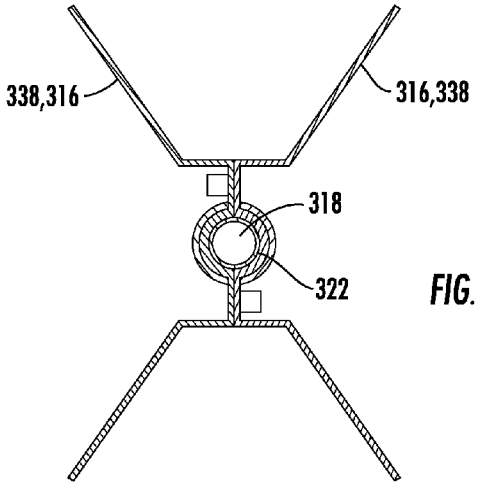
FIG. 20 is a rear view of the tail and tail fin of the exemplary embodiment of FIGS. 15 and 19.
Figure 21:
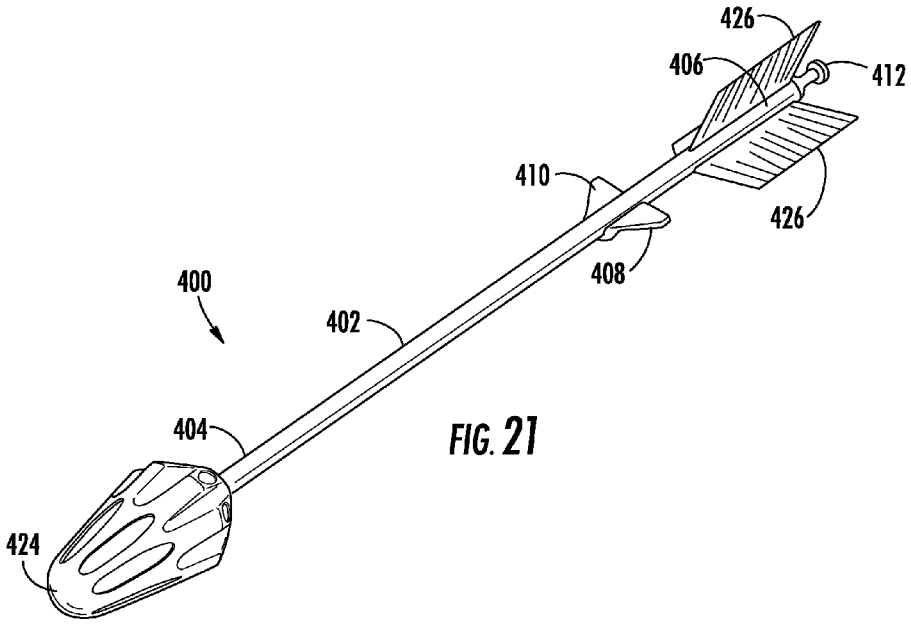
FIG. 21 is a front perspective view of an exemplary bowless arrow embodying one of the present inventions.
Figure 22:
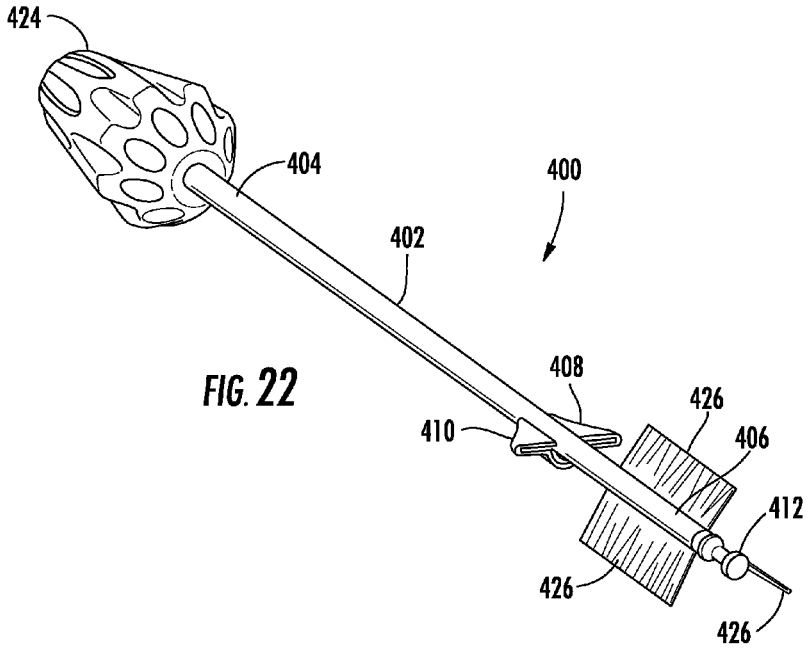
FIG. 22 is a back perspective view of the exemplary embodiment of FIG. 21.
Figure 23:
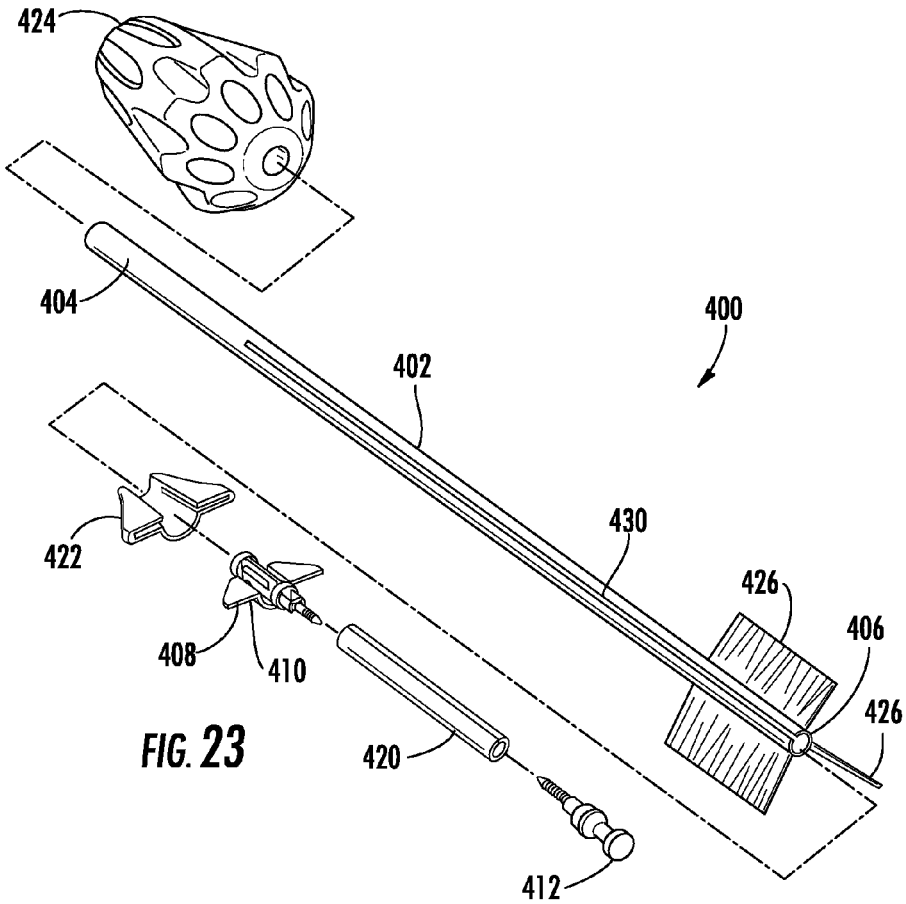
FIG. 23 is an exploded perspective view of the exemplary embodiment in FIG. 22.
Figure 24:
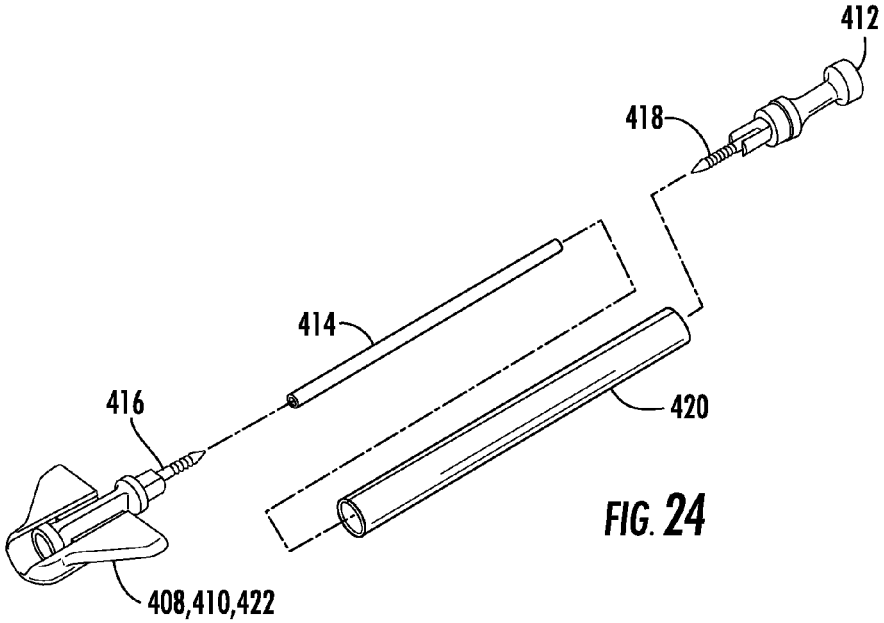
FIG. 24 is an enlarged exploded front perspective view of the launch mechanism of FIG. 23.

The tail fin 316 may be attached to the tail end 318. The tail fin 316 may be either fixedly attached or rotatably attached to the tail end 318. FIGS. 19-20 show an embodiment where the tail fin 316 is rotatably attached to the tail end 318. Bearings 322 may be used to rotatably attach the tail fin 316 to the tail end 318. The tail fin 316 may be comprised of two vacuum-formed plastic parts 338 that are fastened together to capture the bearings 332. For instance, the vacuum-formed plastic parts may be comprised of polycarbonate sheets which are either 10, 15 or 20 thousands of an inch thick. This allows the tail fin 316 to remain light and durable. It is essential for stability that the tail assembly of the toy 300 remain light such that it causes the body 306 of the toy 300 to straighten during flight. Through testing an overly heavy tail assembly shows bad stability during flight and can become uncontrollable. In another embodiment, the tail fin 316 can be angled such that during forward flight, it induces the tail fin 316 to spin. In another embodiment, the tail fin 316 can be a plurality of tail fins 316. As be understood by one skilled in the art a variety of tail designs can be formed as this disclosure is not intended to limit it to any of the precise forms shown and described herein.

The throwing and catching flying toy 300 is the farthest flying football due to the lift-generating wing 304 which allows the toy 300 to actually fly like a glider once thrown in the air. All footballs are simply rotating projectiles. A projectile will travel a set distance that is dependent upon its aerodynamic resistance, exit velocity, overall weight, rotational velocity and various other factors. One variable that is not a factor is lift.

Lift is produced by a wing profile. The reason a football and a wing haven't been combined is that a football body rotates while a wing cannot rotate. A wing can only generate lift if it doesn't rotate and stays relative to the ground. The solution is to allow part of the football to rotate, while allowing the wings to stay stationary.

The center of gravity of the toy 300 in relation along the longitudinal axis 312 should be substantially in the middle of the rear section 310 or near a location between the front section 308 and rear section 310. This means that when the toy 300 is held in the throwing hand about the rear section 310, the center of gravity should be located in the center of the hand as well, but not behind the hand. This allows for a good feeling for throwing the toy 300. If the center of gravity is behind the throwing hand, it is extremely difficult to throw correctly. Therefore, getting the center of gravity within the correct location is critical to making the toy 300 easy to throw.

Another exemplary embodiment not shown would be the integration of the Jetball into the Flying Football. This exemplary embodiment would include the lift-generating wing characteristics of the Flying Football, with the self-propelled characteristics of the Jetball.

Although several embodiments of the throwing and catching flying toy 300 have been described in detail for purposes of illustration, various modifications may be made to each without departing from the scope and spirit of the invention. Accordingly, the invention is not to be limited, except as by the appended claims.

Bowless Arrow:

A typical bow projects arrows by its elasticity. The bow is essentially a form of spring. As the bow is drawn, energy is stored in the limbs of the bow and transformed into rapid motion when the string is released, with the string transferring this force to the arrow. The basic elements of a bow are a pair of curved elastic limbs, traditionally made from wood, connected by a string. By pulling the string backwards the archer exerts compressive force on the string-facing section, or belly, of the limbs as well as placing the outer section, or back, under tension. While the string is held, this stores the energy later released in putting the arrow to flight. When the arrow is shot, the shooter still has the bow remaining in his hands. An arrow cannot be easily projected without the use of a bow.

As shown in FIGS. 21-27, a bowless arrow 400 is now disclosed comprising a shaft 402 defined as including a forward end 404 opposite a rear end 406. A slider 408 is translatably coupled along the shaft 402. The slider 408 includes a front-hand support 410 extending substantially perpendicular to the shaft 402. The slider 408 can be formed to travel on the outside of the shaft 402 or partially on the inside of the shaft 402.

A rear-hand grip 412 is located substantially about the rear end 406 of the shaft 402. A resiliently stretchable bias 414 is attached relative to the slider 408 and either the rear end 406 of the shaft 402 or the rear-hand grip 412. The bias 414 can be a spring, a stretchable material such as a rubber band or any other suitable biasing means. As shown best in FIG. 24, the bias 414 is a tube of rubber or the like. The tube 414 is then pressed onto a barbed end 416 of the slider 408 and a barbed end 418 of the rear-hand grip 412. A cushion 420 can be placed about the bias 414 such that it dissipates the energy from a launch without damaging the internal components. A slider cushion 422 can be formed overtop the slider 408 for safety as well.

In the embodiments shown herein, the bias 414 and a portion of the slider 408 and rear-hand grip 412 are disposed within the shaft 402. This provides for a simplistic appearance. The shaft 402 has a slot 430 that allows the slider 408 to be partially within the shaft 402 while allowing the front-hand support 410 to remain outside. It is to be understood by one skilled in the art that there are a multitude of methods and ways a slider 408 can be translatably coupled along a shaft 402, as this disclosure is not intended to limit it to the precise forms described and shown herein.

An exemplary embodiment may include an arrow tip 424 located at the forward end 404 of the shaft 402. The arrow tip 424 may comprise an energy dissipating material, such as foam or the like. Also, a plurality of tail fins 426 may be substantially evenly located about the rear end 406 of the shaft 402.

Figure 25:
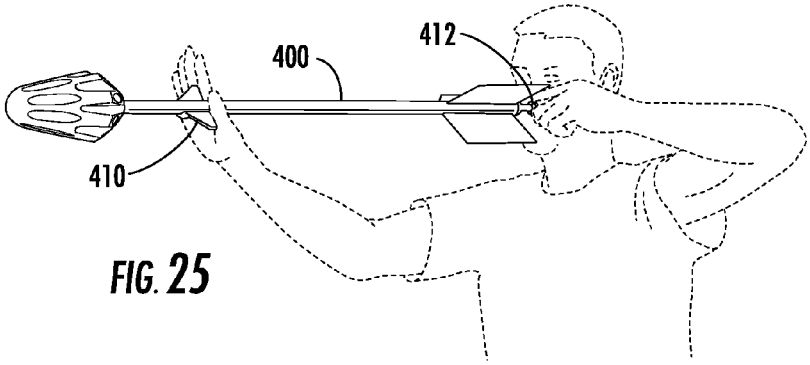
FIG. 25 is a perspective view of the exemplary bowless arrow of FIG. 21 being cocked for launch.
Figure 26:
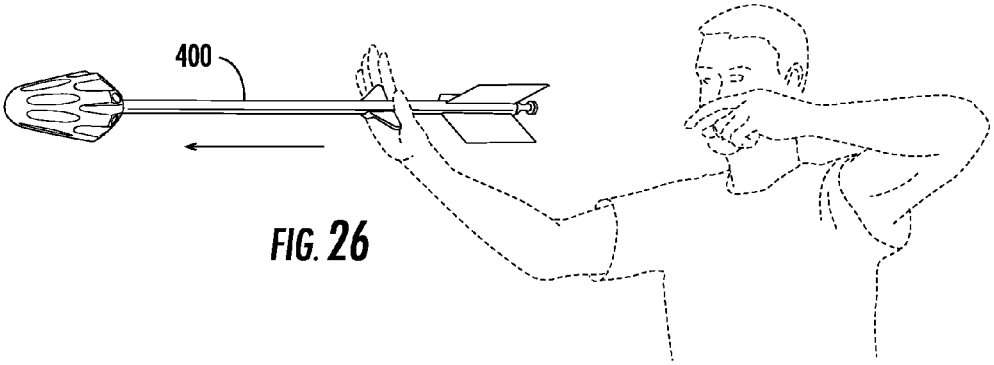
FIG. 26 is a perspective view of the exemplary bowless arrow of FIG. 21 being launched.
Figure 27:
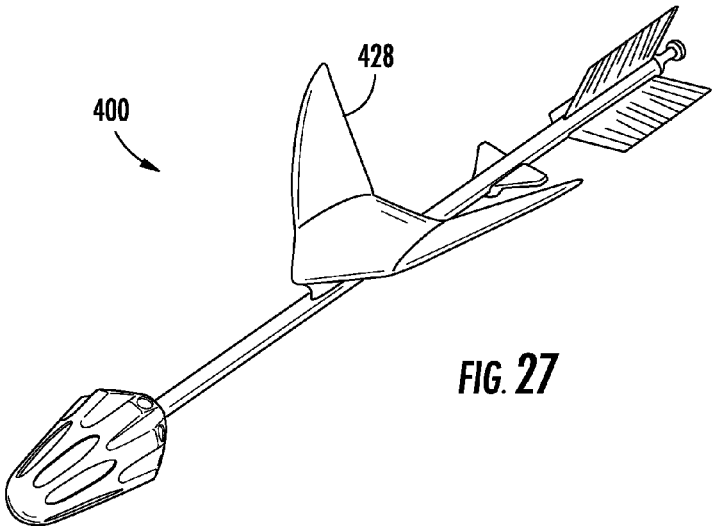
FIG. 27 is a front perspective view of another exemplary bowless arrow embodying one of the present inventions, now with wings.
Figure 28:
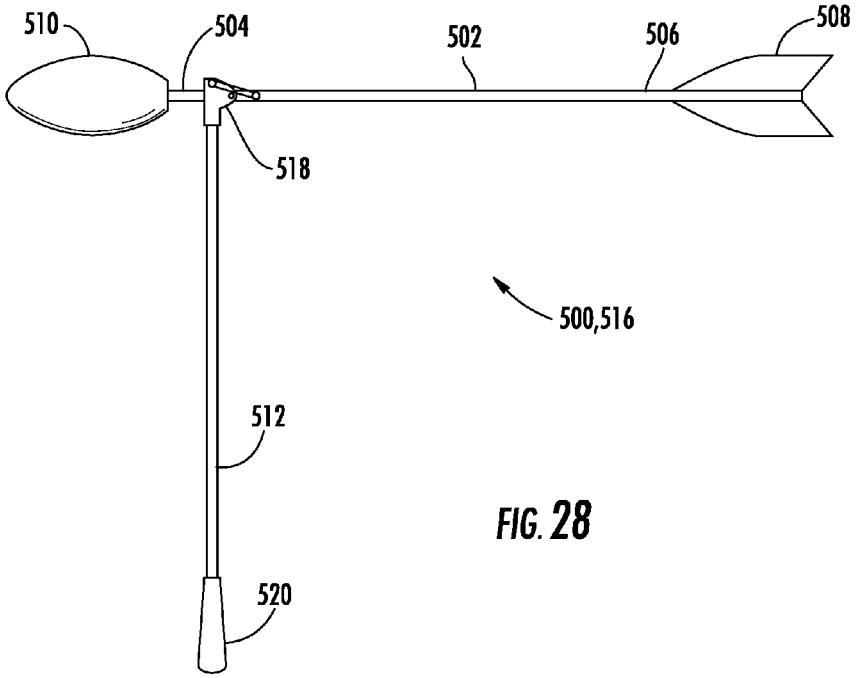
FIG. 28 is a side view of an exemplary distance-enhanced throwing toy embodying one of the present inventions, with handle extended for throwing.
Figure 29:
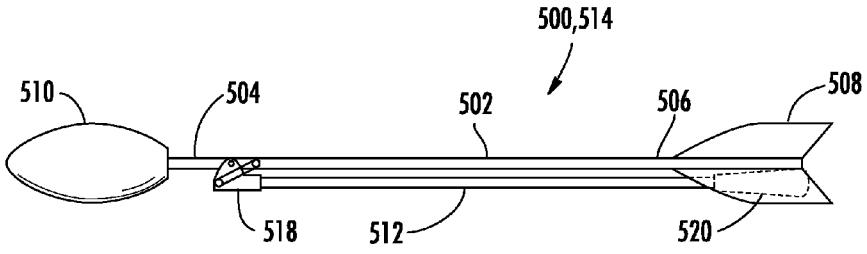
FIG. 29 is a side view of the exemplary embodiment of FIG. 28, with handle retracted for flight.

FIG. 25 shows how the bowless arrow 400 can be drawn. The rear hand of the shooter grasps the rear-hand grip 412 while the front hand of the user is placed upon the front-hand support 410. The bowless arrow 400 is then drawn backwards causing the internal bias 414 to stretch and store energy. As is shown in FIG. 26, when the shooter releases the rear-hand grip 412, the bowless arrow 400 is propelled forward.

Another exemplary embodiment may include a lift-generating wing 428 attached relative to the shaft 402. The lift-generating wing 428 may be similar in design to the methods discussed earlier regarding the flying football, as all the teachings are incorporated herein without repetition. This includes the pivotably adjustable features, the dihedral features, the positioning above the center of gravity, and the breakaway features. The bowless arrow 400 with wing 428 is commonly referred to as the Arrow Plane.

In another exemplary embodiment, the arrow tip 424 may comprise a substantially oblate spheroidal or football shape. This means that the bowless arrow 400 can be used to play catch. The shooter could launch the bowless arrow 400 at a receiver, and the receiver could catch the football arrow tip 424. Then the receiver becomes the shooter launching the bowless arrow 400 back.

Although several embodiments of the bowless arrow 400 have been described in detail for purposes of illustration, various modifications may be made to each without departing from the scope and spirit of the invention. Accordingly, the invention is not to be limited, except as by the appended claims.

Catapult Javelin:

As shown in FIGS. 28-31, a distance-enhanced throwing toy 500 is disclosed comprising an elongated shaft 502 defined as having a forward end 504 opposite a rear end 506. A tail fin 508 is located about the rear end 506 of the shaft 502. Alternatively, the tail fin 508 may comprise a plurality of tail fins 508 substantially evenly located about the rear end 506 of the shaft 502. A tip 510 is located relative to the forward end 504 of the shaft 502. The tip 510 may comprise a multitude of designs previously discussed herein, such as a football shape, an arrow head shape or other various designs. The tip 510 may be comprised of an impact absorbing foam or energy dissipating material to reduce the chance of injuries or for catching the toy 500 once thrown.

An elongated handle 512 is pivotably attached substantially near the forward end 504 of the shaft 502. The handle 512 is temporarily and securedly biased and pivotable between a first position 514 and a second position 516. The handle 512 and shaft 502 are generally parallel in the first position 514. The handle 512 and shaft 502 are generally perpendicular in the second position 516. The elongated handle 512 can also have a grip 520 disposed at its distal end.

Figure 30:
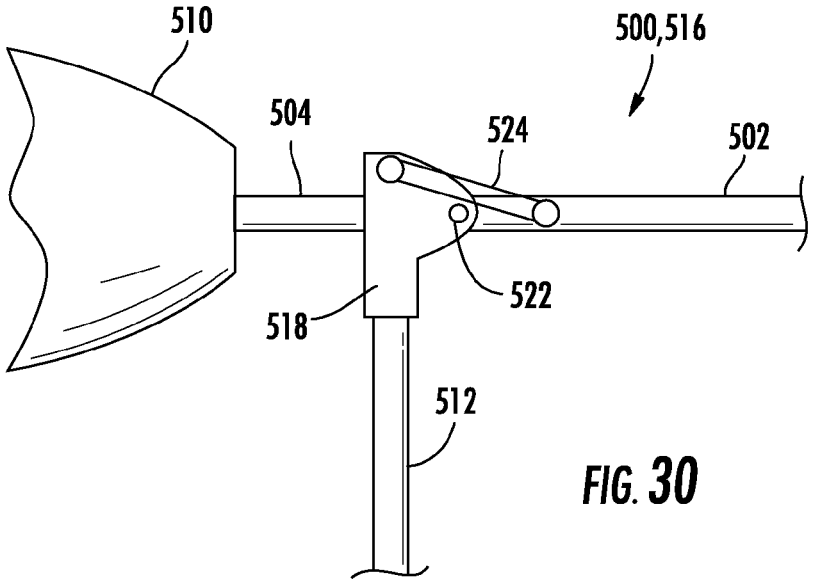
FIG. 30 is an enlarged view of the bias mechanism of the embodiment of FIG. 28, with handle extended for throwing.
Figure 31:
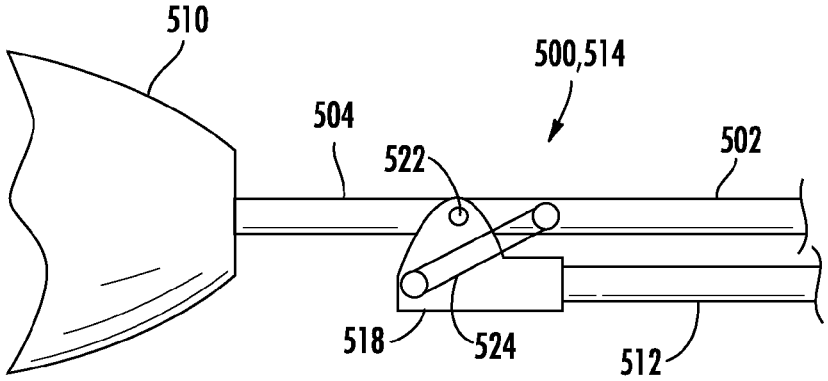
FIG. 31 is an enlarged view of the bias mechanism of the embodiment of FIG. 29, with handle retracted for flight.

As shown better in FIGS. 30-31, a bias mechanism 518 may be attached relative to the shaft 502 and handle 512. The bias mechanism 518 temporarily and securedly biases the handle 512 in the first position 514 and second position 516. The bias mechanism 518 acts in a similar manner to a cam. For instance the handle 512 is pivotably attached to the shaft 502 at the pivot 522. An elastomeric material 524 or spring is properly positioned to hold the handle 512 in the two different positions. As shown in FIG. 30, the handle 512 is in the second position 516. The elastomeric material 524 can be a rubber band or the like. The rubber band 524 is pulling the handle 512 to further open, thereby biasing it to remain in the second position 616. FIG. 31 shows how the same rubber band 524 can then pull the handle 512 to remain in the first position 514 for flight.

When the toy 500 is thrown, the handle 512 is in the second position 516. Upon release, a slight tug of the handle 512 moves it away from the second position 512 and then the angles of the rubber band 524 bias the handle 512 to the first position 514. The handle 512 will then close fully as the toy 500 is in the air. As can be seen by one skilled in the art, there are a multitude of ways and methods for biasing the handle 512 between the two positions 514 and 516 as this disclosure is not intended to limit it to the precise forms shown and described herein.

The toy 500 is capable of being thrown substantially further than a typical throwing toy due to the increased length of the throwing arm, i.e. the handle 512. Our initial prototype was able to easily achieve a distance thrown of over 300 feet. This distance was almost two to three times the distance of a normally thrown toy, such as a football or a baseball. The distance thrown is increased because the release velocity is substantially faster than a person's hand can travel.

After a short bit of practice, it was possible to aim the toy 500 relatively accurately at an intended receiver. The best throwing technique was to throw the toy 500 side arm, as opposed to throwing it overhead. Throwing the toy 500 side arm allowed for a wide range of movement and allowed the hips to rotate and help launch the toy 500.

Although several embodiments of the bowless distance-enhanced throwing toy 500 have been described in detail for purposes of illustration, various modifications may be made to each without departing from the scope and spirit of the invention. Accordingly, the invention is not to be limited, except as by the appended claims.

Figure 32:
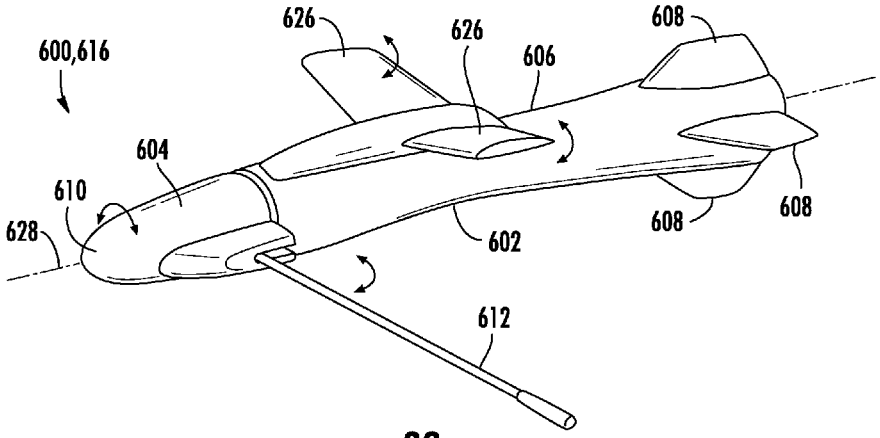
FIG. 32 is a front perspective view of an exemplary throwing and flying toy embodying one of the present inventions, with handle extended for throwing.
Figure 33:
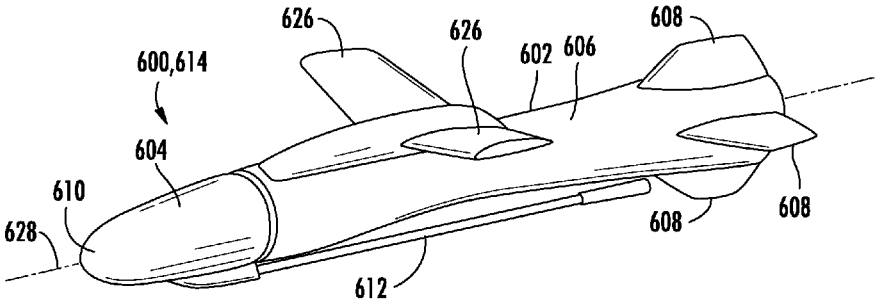
FIG. 33 is a front perspective view of the exemplary embodiment of FIG. 32, with handle retracted for flight.

Cruise Missile:

As shown in FIGS. 32-33, a throwing and flying toy 600 is disclosed which resembles a cruise missile when appropriately styled. The toy 600 incorporates the teachings of the Catapult Javelin and Flying Football herein without repetition. The toy 600 comprises a generally elongated body 602. The body 602 includes a front portion 604 rotatably attached to a rear portion 606. The front portion 604 includes the tip 610, which tip 610 may be formed of an impact dissipating material for safety. In another exemplary embodiment the tip 610 can be styled like an arrow head or football.

A tail fin 608 is located about the rear portion 606 of the body 602. The tail fin 608 may also comprise a plurality of tail fins 608 substantially evenly disposed about the rear portion 606. The plurality of tails fins 608 may be fixedly attached to the rear portion 606 or rotatably attached to the rear portion 606.

A lift-generating wing 626 is attached relative to the rear portion 606 of the body 602. The wing 626 may be similar in design to the methods discussed earlier regarding the Flying Football, as all the teachings are incorporated herein without repetition. This includes the pivotably adjustable features, the dihedral features, the positioning above the center of gravity, and the breakaway features.

An elongated handle 612 is pivotably attached relative to the front portion 604 of the body 602. The handle 612 is temporarily and securedly biased and pivotable between a first position 614 and a second position 616. The handle 612 and body 602 are generally parallel in the first position 614 and the handle 612 and body 602 are generally perpendicular in the second position 616. This is similar in design to the methods discussed earlier regarding the Catapult Javelin, as all the teaching are incorporated herein without repetition.

A bias mechanism similar to 518 may be attached relative to the front portion 604 and handle 612. The bias mechanism 518 temporarily and securedly biases the handle 612 in the first position 614 and second position 616. The bias mechanism 518 is similar in design to the mechanism of the Catapult Javelin. For instance, the handle 612 is pivotably attached to the front portion 604 at a pivot similar to the pivot 522. An elastomeric material 524 or spring is properly positioned to hold the handle 612 in the two different positions. As shown in FIG. 32, the handle 612 is in the second position 616. The elastomeric material 524 can be a rubber band or the like. The rubber band 524 is pulling the handle 612 to further open, thereby biasing it to remain in the second position 616. FIG. 32 shows how the same rubber band 524 can then pull the handle 612 to remain in the first position 614 for flight.

In another exemplary embodiment, the body 602 may comprise a substantially missile-like shape. When the toy 600 is in the air, the weight of the handle 612 will rotate the front portion 604 downwards such that the handle 612 remains below the body 602. When the toy 600 is about to be thrown, the rear portion 606 must be weight biased to remain upright, because this embodiment does not include the equivalent of a thumb grip as did the Flying Football. This means that the overall weight of the rear portion 606 must have a center of gravity below the longitudinal axis 628 such that the wing 626 doesn't cause the rear portion 606 to rotate upside-down before a throw. This can be accomplished by placing a weight below the longitudinal axis 628 affixed to the rear portion 606. Once the toy 600 is in the air, the dihedral and high mounted wing location keeps the wings 626 upright during flight.

The overall weight of the toy 600 should be around 150 grams. The light weight allows a fast whipping action that is needed to reach increased velocities. Furthermore, a light weight toy 600 will impart less energy if it does hit an object, such as a person. Even though the toy 600 may be traveling extremely fast, it is hard to create an injury if the overall mass is extremely low.

Although several embodiments of the throwing and flying toy 600 have been described in detail for purposes of illustration, various modifications may be made to each without departing from the scope and spirit of the invention. Accordingly, the invention is not to be limited, except as by the appended claims.

As used herein throughout the entirety of this disclosure: substantially means largely but not wholly that which is specified; plurality means two or more; disposed means joined or coupled together or to bring together in a particular relation; and longitudinal means of, relating to, or occurring in the lengthwise dimension or relating to length.

Although several inventions and embodiments of each have been described in detail for purposes of illustration, various modifications may be made to each without departing from the scope and spirit of the invention. Accordingly, the invention is not to be limited, except as by the appended claims.

REFERENCE NUMBER LIST

Jetball:
10 Self-Propelled Flying Toy
12 Body
14 Front Section
16 Center Section
18 Rear Section
20 Longitudinal Axis
22 Ducted Fan
24 Electric Motor
26 Electrical Power Source
27 Structural Supports
28 Air-Inlet
30 Air-Outlet
32 On-Off Switch
34 Accelerometer
36 Microcontroller
38 Air-Permeable Structure
40 Charging Port
42 Lever Switch
44 Lever
46 Switch Body
48 Button
50 Electrical Connection Stubs
52 Weight
54 Conductive Mass
56 Circuit Gap
58 Cylindrical Hole
60 Electrical Circuit
62 Reed Switch
64 Permanent Magnet
66 First Ducted Fan
68 Second Ducted Fan
70 Pitch Adjustable Single Ducted Fan
72 Laces
74 Sliding Hub
76 Main Hub
78 Linkage
80 Self Propelled Flying Toy
82 Angled Surfaces

84 Truncated End
86 Auxiliary Air-Inlet
88 Aperture
90 Smaller Gear
92 Larger Gear
94 Centrifugal Switches
96 Timer
98 First Section
100 Second Section
102 First Plastic Screen
104 Second Plastic Section
106 Electrical Board
PropRocket:
200 Self-Propelled Rocket Toy
202 Elongated Body
204 Longitudinal Axis
206 Top End
208 Bottom End
210 Propeller
212 Electric Motor
214 Power Source
216 Activation Mechanism
218 Outwardly Extending Supports
220 Auxiliary Charger
222 Ring
224 Charger Port
226 Launch Button, On Body
228 Timer
230 Receiver
232 Remote Launch Transmitter
234 Centrifugal Switch
236 Stand
238 Tethered Launch Button
240 Launch Button, On Stand
242 Frame
244 Electrical Board
Flying Football:
300 Throwing And Catching Flying Toy
302 Structural Support
304 Lift-Generating Wing
306 Body
308 Front Section
310 Rear Section
312 Longitudinal Axis
314 Tail
316 Tail Fin
318 Tail End
320 Thumb Grip
322 Bearing
324 Pitch Axis
326 Pivot
328 Screw
330 Bias
332 Dihedral Angle
334 Horizontal Section
336 Dihedral Section
338 Vacuum-Formed Plastic Part
Bowless Arrow:
400 Bowless Arrow
402 Shaft
404 Forward End
406 Rear End
408 Slider
410 Front-Hand Support
412 Rear-Hand Support
414 Resiliently Stretchable Bias
416 Barbed End, Slider
418 Barbed End, Rear-Hand Grip
420 Cushion
422 Slider Cushion
424 Arrow Tip
426 Plurality Of Tail Fins
428 Lift-Generating Wing
430 Slot
Catapult Javelin:
500 Distance-Enhanced Throwing Toy
502 Elongated Shaft
504 Forward End
506 Rear End
508 Tail Fin
510 Tip
512 Elongated Handle
514 First Position
516 Second Position
518 Bias Mechanism
520 Grip
522 Pivot
524 Elastomeric Material
Cruise Missile:
600 Throwing And Flying Toy
602 Elongated Body
604 Front Portion
606 Rear Portion
608 Tail Fin
610 Tip
612 Elongated Handle
614 First Position
616 Second Position
518 Bias Mechanism
620 Grip
522 Pivot
524 Elastomeric Material
626 Lift-Generating Wing
628 Longitudinal Axis

What is claimed is:

1. A self-propelled flying toy, comprising:

a body defined as comprising a front section, a center section and a back section each along a longitudinal axis;

a ducted fan disposed within the body substantially centered about the longitudinal axis; a motor mechanically coupled to the ducted fan and fixed relative to the body;

a power source electrically coupled to the motor;

an air-inlet disposed substantially within the front section in airflow communication with the ducted fan;

an air-outlet disposed substantially within the back section in airflow communication with the ducted fan; and at least two substantially flat angled surfaces fixed relative to the body disposed substantially within the front section, wherein each of the at least two angled surfaces are substantially evenly centered about the longitudinal axis producing a thrust in a same longitudinal direction as the ducted fan and facing an opposite direction relative to the ducted fan.

2. The toy of claim 1, wherein the at least two angled surfaces are in airflow communication with the air-inlet.

3. The toy of claim 2, wherein the at least two angled surfaces comprise a plurality of angled surfaces.

4. The toy of claim 1, wherein the body is an oblate spheroidal shape.

5. The toy of claim 4, wherein the oblate spheroidal body is truncated perpendicular to the longitudinal axis disposed substantially about the back section.

6. The toy of claim 5, wherein the air-outlet is substantially 3.5 inches in diameter or greater.

7. The toy of claim 1, including an auxiliary air-inlet disposed substantially within the center section about the longitudinal axis in airflow communication with the ducted fan.

8. The toy of claim 7, wherein the auxiliary air-inlet comprises a plurality of auxiliary air-inlets.

9. The toy of claim 8, wherein the plurality of auxiliary air-inlets each define an aperture extending substantially 0.5 inches or greater ahead and substantially 0.5 inches or greater behind the ducted fan in a direction along the longitudinal axis.

10. The toy of claim 7, wherein the air-inlet, auxiliary air-inlet and air-outlet each comprise an air-permeable structure.

11. The toy of claim 1, including a centrifugal switch disposed within the body detecting rotation about the longitudinal axis.

12. The toy of claim 11, wherein the centrifugal switch regulates operation of the ducted fan, where the ducted fan is powered when rotation about the longitudinal axis is detected and not powered when rotation about the longitudinal axis is not detected.

13. The toy of claim 1, including a means for automatic activation and deactivation of the motor by detecting an in-flight condition and a not-in-flight condition, wherein such means is located within the body and in communication with the motor and power source.

14. The toy of claim 13, including a timer located within the body in communication with the motor and power source, wherein the motor after activation will automatically turn off after a predetermined time.

15. The toy of claim 1, wherein a first inherent gyroscopic precession of the ducted fan is substantially opposite in direction and substantially equal in magnitude compared to a second inherent gyroscopic precession of the at least two angled surfaces.

16. A self-propelled flying toy, comprising:

a fan substantially centered about a longitudinal axis;

a motor mechanically coupled to the fan; a power source energetically coupled to the motor;

a centrifugal switch in electrical communication with the motor and power source controllably powering the fan when rotation about the longitudinal axis is detected and not powering the fan when rotation about the longitudinal axis is not detected; and at least two substantially flat angled surfaces fixed relative to and ahead of the motor, where each of the at least two angled surfaces are substantially evenly centered about the longitudinal axis producing thrust in a same longitudinal direction as the fan and facing an opposite direction relative to the fan;

wherein a first inherent gyroscopic precession of the fan is substantially opposite in direction and substantially equal in magnitude compared to a second inherent gyroscopic precession of the at least two angled surfaces.

17. The toy of claim 16, including a body defined as comprising a front section, a center section and a back section each along the longitudinal axis where the body is fixed relative to the motor, and including an air-inlet disposed substantially within the front section in airflow communication with the fan and an air-outlet disposed substantially within the back section in airflow communication with the fan.

18. The toy of claim 17, wherein the body is a substantially oblate spheroidal shape and including a plurality of auxiliary air-inlets disposed substantially within the center section about the longitudinal axis in airflow communication with the fan.

19. A self-propelled flying toy, comprising:

a substantially oblate spheroidal body disposed along a longitudinal axis;

a fan disposed within the body substantially centered about the longitudinal axis;

a motor mechanically coupled to the fan and fixed relative to the body;

a power source energetically coupled to the motor; and at least two substantially flat angled surfaces fixed relative to the body and ahead of the motor, where each of the at least two angled surfaces are substantially evenly centered about the longitudinal axis producing thrust in a same longitudinal direction as the fan and facing an opposite direction relative to the fan;

wherein a first inherent gyroscopic precession of the fan is substantially opposite in direction and substantially equal in magnitude compared to a second inherent gyroscopic precession of the at least two angled surfaces.

20. The toy of claim 19, including a centrifugal switch in electrical communication with the motor and power source controllably powering the fan when rotation about the longitudinal axis is detected and not powering the fan when rotation about the longitudinal axis is not detected.

21. The toy of claim 20, including an air-inlet disposed substantially within a front section of the body in airflow communication with the fan and an air-outlet disposed substantially within a back section of the body in airflow communication with the fan and a plurality of auxiliary air-inlets disposed substantially around the fan and longitudinal axis in airflow communication with the fan.

22. A self-propelled flying toy, comprising:

a fan centered about a longitudinal axis;

a motor mechanically coupled to the fan;

a power source coupled to the motor;

an air-inlet in airflow communication with the fan disposed ahead of the fan and fixed relative to the motor;

an air-outlet in airflow communication with the fan disposed behind the fan and fixed relative to the motor; and at least two fixed angled surfaces disposed ahead of the fan and fixed relative to the motor, wherein each of the at least two angled surfaces are evenly centered about the longitudinal axis producing thrust in a same longitudinal direction as the fan and facing an opposite direction relative to the fan;

wherein a first inherent gyroscopic precession of the fan is substantially opposite in direction and substantially equal in magnitude compared to a second inherent gyroscopic precession of the at least two angled surfaces.

23. The toy of claim 22, including a plurality of auxiliary air-inlets disposed substantially around the fan and longitudinal axis in airflow communication with the fan.

24. The toy of claim 22, including a centrifugal switch in electrical communication with the motor and power source controllably powering the fan when rotation about the longitudinal axis is detected and not powering the fan when rotation about the longitudinal axis is not detected.

* * * * *